US009199246B1

(12) United States Patent
Kikutani et al.

(10) Patent No.: US 9,199,246 B1
(45) Date of Patent: Dec. 1, 2015

(54) GOLD CONCENTRATE RECOVERY SYSTEM AND GOLD CONCENTRATE RECOVERY METHOD

(71) Applicant: SUMITOMO METAL MINING CO., LTD., Tokyo (JP)

(72) Inventors: Hideki Kikutani, Tokyo (JP); Daishi Ochi, Tokyo (JP); Takeshi Nakamura, Tokyo (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 0 days.

(21) Appl. No.: 14/500,262

(22) Filed: Sep. 29, 2014

(51) Int. Cl.
*B03B 5/06* (2006.01)

(52) U.S. Cl.
CPC ..... *B03B 5/06* (2013.01)

(58) Field of Classification Search
CPC ..... B03B 5/04; B03B 5/06; B03B 5/26; B03B 5/62; B03B 4/00; B03B 4/02; B07B 13/113; B07B 1/30; B07B 13/003; B07B 1/4654
USPC ..... 209/441, 480, 479, 506, 507
See application file for complete search history.

(56) References Cited

U.S. PATENT DOCUMENTS

| | | | | | |
|---|---|---|---|---|---|
| 666,002 | A | * | 1/1901 | Dodd | 209/441 |
| 682,371 | A | * | 9/1901 | Taylor | 209/441 |
| 780,031 | A | * | 1/1905 | Forster | 209/441 |
| 1,111,992 | A | * | 9/1914 | Butchart | 209/441 |
| 1,180,210 | A | * | 4/1916 | Thompson et al. | 209/441 |
| 1,276,529 | A | * | 8/1918 | Horn | 209/485 |
| 1,335,824 | A | * | 4/1920 | Deister et al. | 209/441 |
| 1,343,266 | A | * | 6/1920 | Hughes | 209/441 |
| 1,368,815 | A | * | 2/1921 | McNeil | 209/441 |
| 1,382,275 | A | * | 6/1921 | Deister | 209/441 |
| 1,513,693 | A | * | 10/1924 | Butchart | 209/441 |
| 1,597,066 | A | * | 8/1926 | Deister | 209/441 |
| 1,956,296 | A | * | 4/1934 | Martin | 209/441 |
| 2,269,307 | A | * | 1/1942 | Dickerson | 209/467 |
| 2,604,208 | A | * | 7/1952 | Le Baron | 209/441 |
| 3,080,056 | A | * | 3/1963 | Fernstrom et al. | 209/467 |
| 4,521,302 | A | * | 6/1985 | Stone | 209/441 |
| 4,946,586 | A | * | 8/1990 | Fletcher | 209/435 |
| 6,818,042 | B2 | | 11/2004 | Peacocke et al. | |

FOREIGN PATENT DOCUMENTS

JP 2012-139675 A 7/2012

* cited by examiner

*Primary Examiner* — David H Bollinger
(74) *Attorney, Agent, or Firm* — Osha Liang LLP

(57) ABSTRACT

The gold concentrate recovery system and a gold concentrate recovery method capable of recovering gold concentrates from gold ores with high efficiency and stability. The system and method include a shaking table 2 including a plurality of riffles 3 provided on an upper surface 2*a*. The riffles 3 include a plurality of first riffles 3*a* provided on the upper surface 2*a* of the shaking table 2, and at least a second riffle 3*b* disposed in a flat area 12 where the first riffles 3*a* are not provided.

10 Claims, 21 Drawing Sheets

GOLD CONCENTRATE RECOVERY SYSTEM AND GOLD CONCENTRATE RECOVERY METHOD

BACKGROUND

1. Technical Field

The present invention relates to a gold concentrate recovery system and a gold concentrate recovery method for recovering gold concentrates from gold ores containing gangue minerals or sulfide minerals.

2. Related Art

There are various concentration methods adopted for recovering concentrates from ores. For example, a gold ore concentration method currently employed crushes gold ores, and pulverizes the gold ores into particles having an appropriate particle size. The recovered concentrate particles are suspended in cyanide solution to leach gold. This method is called a cyanide process, by which process gold is separated from gangue minerals or sulfide minerals and concentrated. Another method currently employed initially separates gold concentrates from gangue minerals or sulfide minerals by gravity concentration and flotation, and then further separates and concentrates gold by using the cyanide process.

According to the cyanide process performed in these methods, entire gold contained in coarse ore particles is difficult to be dissolved. In this case, gold recovery is insufficiently achieved.

For overcoming this drawback, a technology of table gravity concentration (also called flowing film concentration) is proposed as a method for recovering high-grade gold concentrates. This method achieves direct refinement only by performing gravity concentration (for example, see Patent Literature 1). In addition, such a technology is proposed which automates control of a partition plate by combining the foregoing table gravity concentration and an image processing technology (for example, see Patent Literature 2).

FIG. 24 illustrates the principle of the table gravity concentration. This concentration is a method using a shaking table 102 provided with a plurality of riffles 103, and supplies ore slurry from an ore supply launder 104 to the shaking table 102 in the width direction of the shaking table 102 while oscillating the shaking table 102 in the extension direction of the riffles 103 by using a shaking driving mechanism 111. The ore slurry is produced from a mixture of ores pulverized into ore particles, and water added to the ore particles. This method further supplies additive water from a water supply launder 105 in the width direction of the shaking table 102 as indicated by arrows 160 in FIG. 24.

In this case, low specific gravity ore particles having low specific gravity such as gangue minerals and sulfide minerals contained in the ore slurry supplied to the shaking table 102 go over the riffles 103 by the flow of the additive water supplied from the water supply launder 105 independently from the oscillation movement of the shaking table 102. Then, these low specific gravity ore particles fall toward a front side surface 102*c* of the shaking table 102 as indicated by arrows 150*a*, 150*b*, and 150*c* in FIG. 24, and are recovered as tailings into a first tailing recovery storage tank 108.

On the other hand, high specific gravity ore particles having high specific gravity shift in the extension direction of the riffles 103 in accordance with the oscillation movement of the shaking table 102, and flow out of the riffles 103 into a flat area 112 where the riffles 103 are not provided. Ore particles having large particle diameters are more likely to shift in the water flow direction of the additive water (width direction of the shaking table 102) by the flow of the additive water supplied from the water supply launder 105 or by others than ore particles having small particle diameters when the specific gravity of these large particle diameter and small particle diameter ore particles are the same. Accordingly, a stream 140*a* of high specific gravity, small particle diameter, and high gold grade ore particles, and a stream 140*b* of high specific gravity and large particle diameter ore particles are formed in the flat area 112. The stream 140*a* of high specific gravity, small particle diameter, and high gold grade ore particles is separated from the stream 140*b* of high specific gravity and large particle diameter ore particles by using a partition plate 107. The high specific gravity, small particle diameter, and high gold grade ore particles are recovered as concentrates into a concentrate recovery storage tank 110, while the high specific gravity and large particle diameter ore particles are recovered as tailings into a second tailing recovery storage tank 109. The part forming a stream of high gold grade ore particles is called a gold line.

The gold concentrates recovered by this method are directly smelted and casted, and produced into ingot products (called dore as well) having a purity of 90% or higher.

CITATION LIST

Patent Literature

Patent Literature 1: U.S. Pat. No. 6,818,042

Patent Literature 2: JP 2012-139675 A

Depending on the characteristics of gold ores, it may occur that the pulverization of gold ores into an appropriate particle size produces both fine ore particles having high specific gravity (that is, having a large gold content) and having particle diameters of approximately 100 μm, and coarse ore particles having high specific gravity similarly to the specific gravity of the fine ore particles and having particle diameters approximately in the range from 200 μm to 500 μm. In this case, a part of the high specific gravity and large particle diameter gold ore particles shift in the water flow direction of the additive water by the flow of the additive water supplied from the water supply launder 105 or by others while flowing in the flat area 112, and form a stream different from the stream (first gold line) 140*a* of high specific gravity, small particle diameter, and high gold grade ore particles as illustrated in FIG. 24. More specifically, a part of the high specific gravity and large particle diameter gold ore particles, which form a stream (second gold line) 140*c* of high specific gravity, large particle diameter, and high gold grade ore particles, remain in the stream (tailing layer) 140*b* of the high specific gravity and large particle diameter ore particles. These high specific gravity and large particle diameter gold ore particles forming the second gold line 140*c* are recovered as tailings.

There is still another problem arising from the foregoing method. When the stream (first gold line) 140*a* of the high specific gravity, small particle diameter, and high gold grade ore particles is not linear, errors produced in separating the stream (first gold line) 140*a* of the high specific gravity, small particle diameter, and high gold grade ore particles from the stream (tailings layer) 140*b* of the high specific gravity and large diameter ore particles increase by the partition plate 107, in which condition the operation is difficult to stabilize. More specifically, when the first gold line 140*a* has deviation or winding, ore particles which should be recovered as concentrates may be recovered as tailings. On the other hand, ore particles which should be recovered as tailings may be recovered as concentrates. Furthermore, the partition plate 107 needs to move in accordance with deviation or winding of the first gold line 140*a* while monitoring the first gold line 140*a* during operation.

SUMMARY

The present invention has been developed to solve the aforementioned problems. It is an object of the present invention to provide a gold concentrate recovery system and a gold concentrate recovery method capable of recovering gold concentrates from gold ores with high efficiency and stability.

A gold concentrate recovery system recovering gold concentrates according to the present invention is a gold concentrate recovery system recovering gold concentrates from gold ores including: a shaking table including a plurality of riffles on an upper surface of the shaking table, and oscillating in the extension direction of the riffles, wherein the riffles include a plurality of first riffles disposed on the upper surface of the shaking table, and at least a second riffle disposed on the upper surface of the shaking table in a flat area where the first riffles are not provided, the first riffles concentrate ore particles based on specific gravity of the ore particles, and generate a gold line in the flat area, the ore particles being particles of gold ores supplied together with additive water, and the second riffle is disposed on the downstream side of flow of the additive water and on the downstream side of a stream of the gold line with respect to a position where the gold line starts appearing in the flat area, and returns, again to the gold line, gold ore particles shifted toward the downstream side of the flow of the additive water in the flat area by the flow of the additive water and separated from the gold line.

In a gold concentrate recovery method according to the present invention a plurality of first riffles on an upper surface of a shaking table oscillated in the extension direction of the first riffles concentrate ore particles based on specific gravity of the ore particles, and generate a gold line in a flat area on the upper surface of the shaking table, the ore particles being particles of gold ores supplied to the upper surface of the shaking table together with additive water, and the flat area being an area where the first riffles are not provided, and at least a second riffle provided on the flat area, and disposed on the downstream side of flow of the additive water and on the downstream side of a stream of the gold line with respect to a position where the gold line starts appearing in the flat area returns, again to the gold line, gold ore particles shifted toward the downstream side of the flow of the additive water in the flat area by the flow of the additive water and separated from the gold line.

According to the present invention, the first riffles are disposed on the upper surface of the shaking table of the table gravity concentrator to concentrate ore particles based on specific gravity of the ore particles. The ore particles are particles of gold ores supplied together with additive water. Moreover, at least the one second riffle is disposed on the upper surface of the shaking table in the flat area, which is an area where the first riffles are not disposed and an area where the gold line is generated, on the downstream side of the flow of the additive water and on the downstream side of the stream of the gold line with respect to the position where the gold line starts appearing in the flat area. According to the present invention, therefore, the second riffle returns, again to the gold line, gold ore particles shifted toward the downstream side of the flow of the additive water in the flat area by the flow of the additive water and separated from the gold line. Accordingly, the table gravity concentrator recovers not only high specific gravity and small particle diameter gold ore particles, but also high specific gravity and large particle diameter gold ore particles not as tailings as recovered in the conventional method, but as concentrates. Thus, efficient recovery of gold ore particles is achievable.

Moreover, according to the present invention, at least the one second riffle is positioned on the downstream side of the flow of the additive water and on the downstream side of the stream of the first gold line with respect to the position where the gold line starts appearing in the flat area. In this case, the gold line becomes more linear and deviation and winding of the gold line are reduced. Accordingly, this structure decreases, more than the conventional method, the possibility that ore particles which should be recovered as concentrates are recovered as tailings, and the possibility that ore particles which should be recovered as tailings are recovered as concentrates. This advantage can reduce errors produced in separating the stream (first gold line) of high specific gravity, small particle diameter, and high gold grade ore particles from the stream (tailing layer) of high specific gravity and large particle diameter ore particles, and allow efficient and stable recovery of gold ore particles. Furthermore, according to the present invention, the higher linearity of the stream of the gold line reduces or eliminates to none the labor of shifting the partition plate in accordance with deviation and winding of the gold line while monitoring the gold line during operation. Accordingly, efficient and stable recovery of gold ore particles is achievable.

DETAILED DESCRIPTION

A gold concentrate recovery system and a gold concentrate recovery method according to the present invention are hereinafter described in detail with reference to the drawings. The present invention is not limited to the examples described herein, but may be modified in arbitrary manners without departing from the scope of the present invention.

Figure 1:
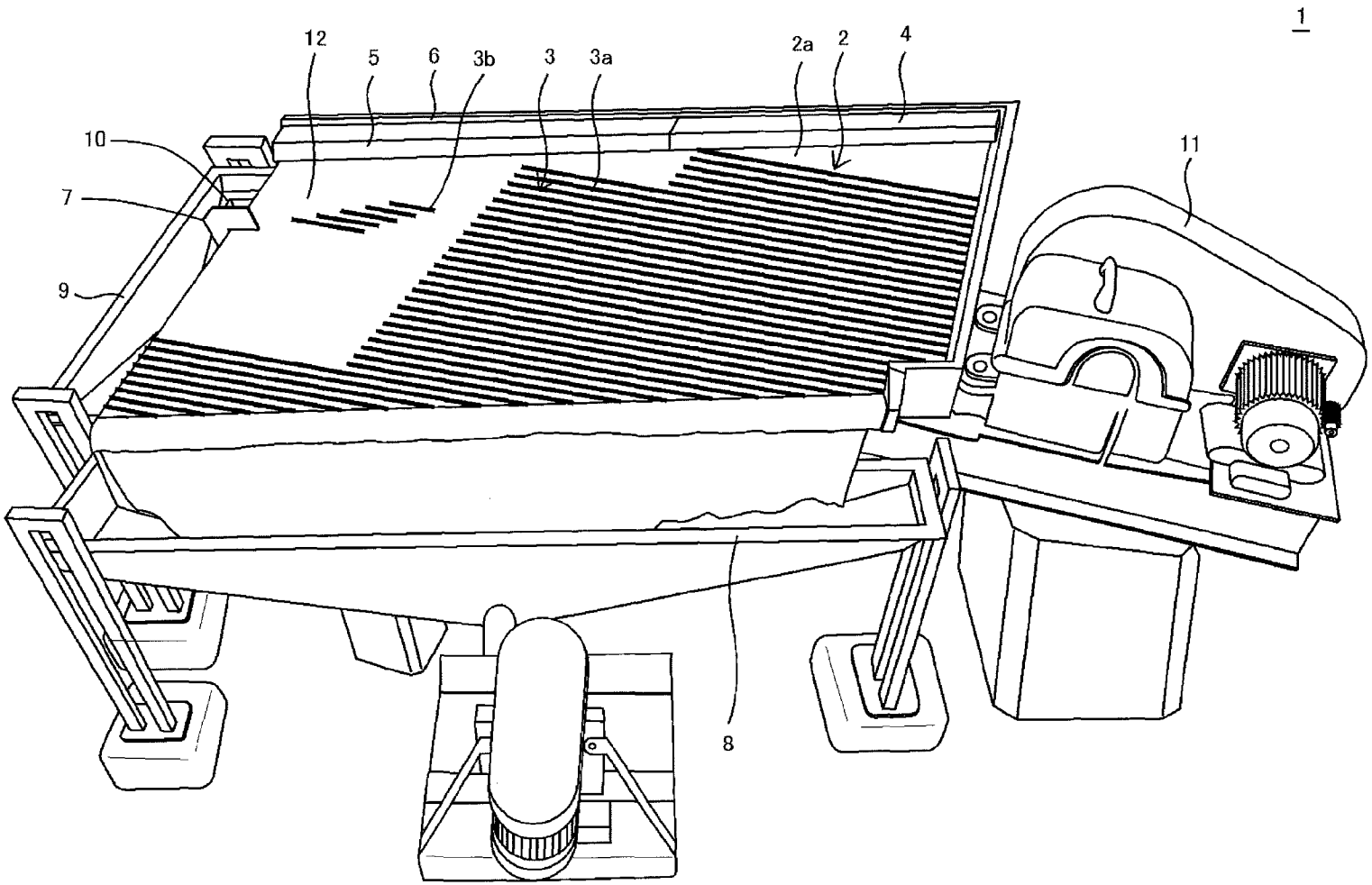
FIG. 1 is a perspective view illustrating a table gravity concentrator.
Figure 2:
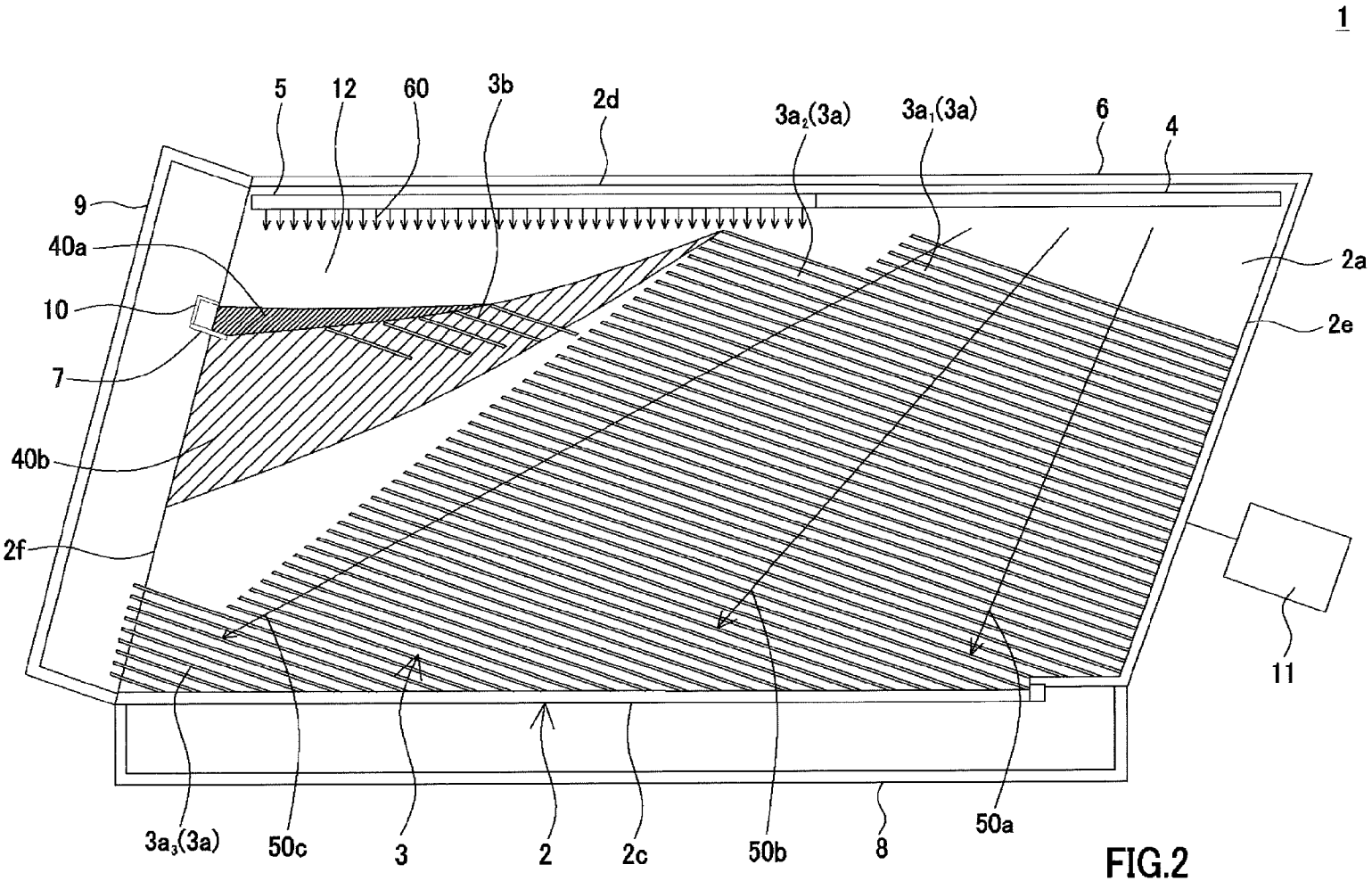
FIG. 2 is a plan view illustrating a table gravity concentrator according to a first example.
Figure 3:
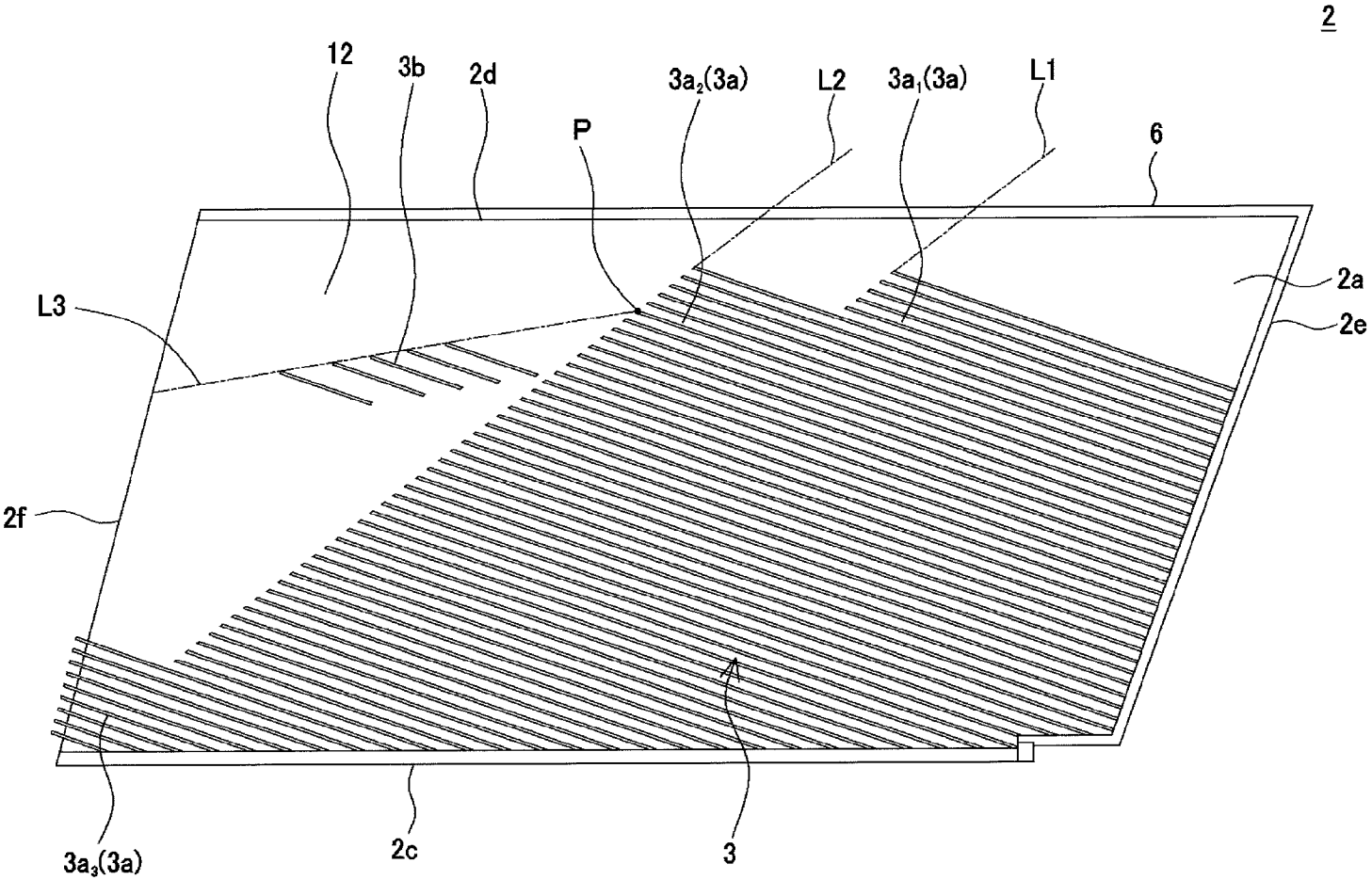
FIG. 3 is a plan view illustrating a shaking table according to the first example.
Figure 4:
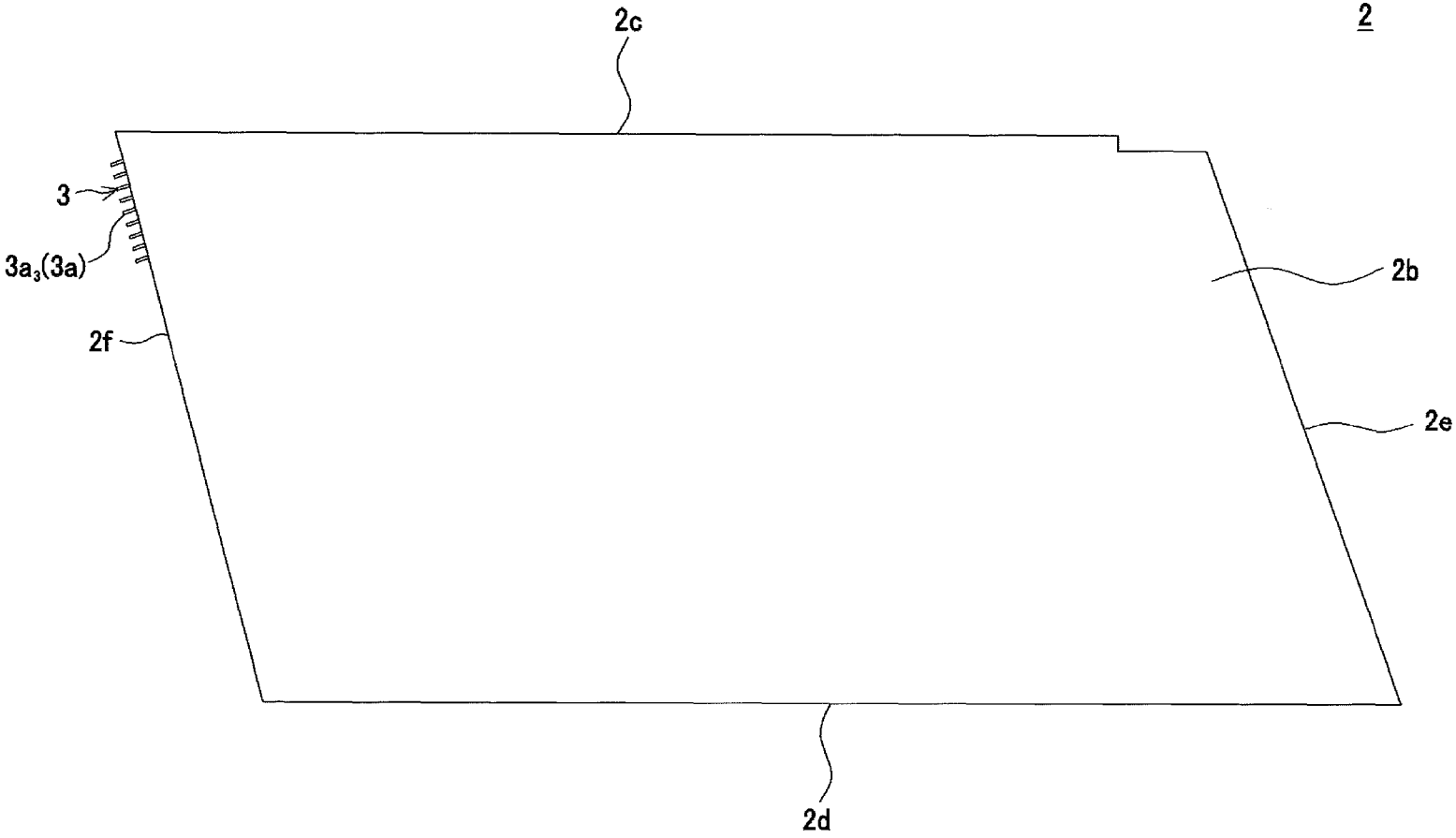
FIG. 4 is a bottom view illustrating the shaking table according to the first example.
Figure 5:
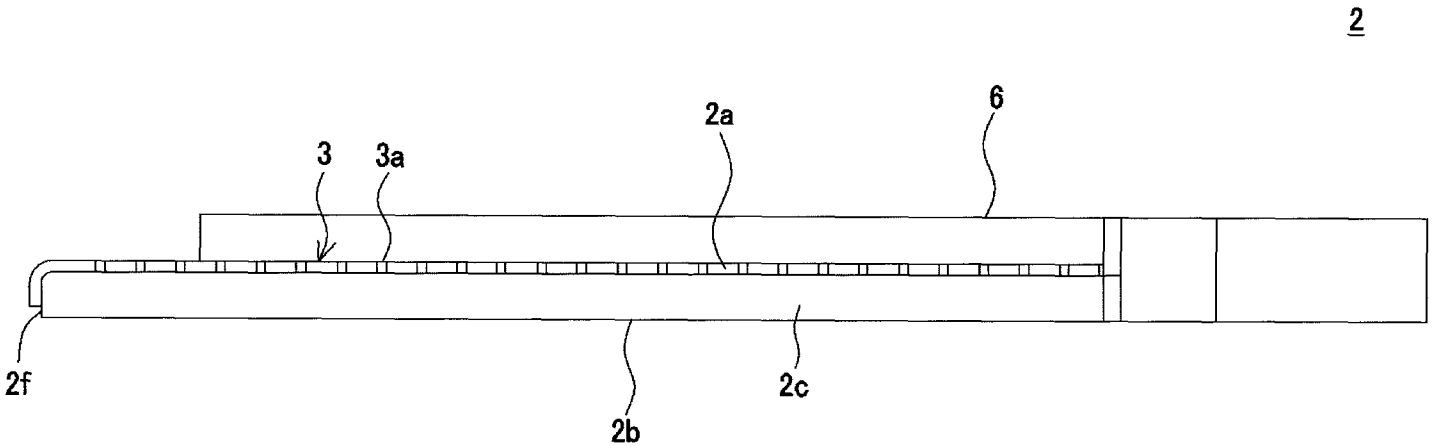
FIG. 5 is a front view illustrating the shaking table according to the first example.
Figure 6:
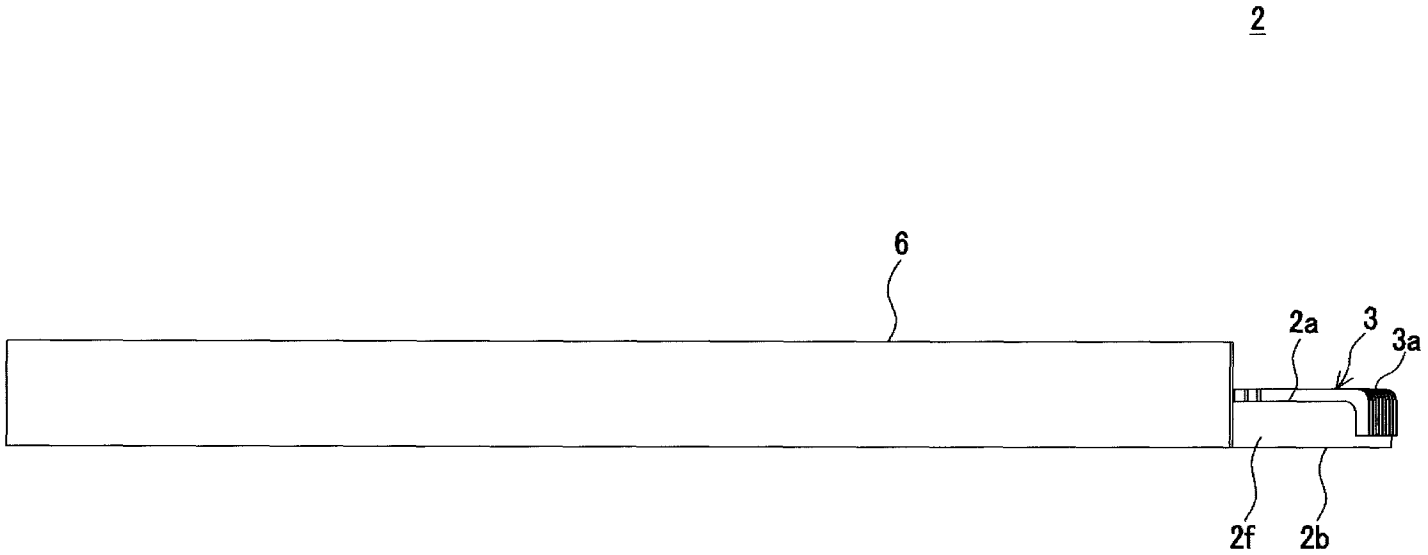
FIG. 6 is a back view illustrating the shaking table according to the first example.
Figure 7:
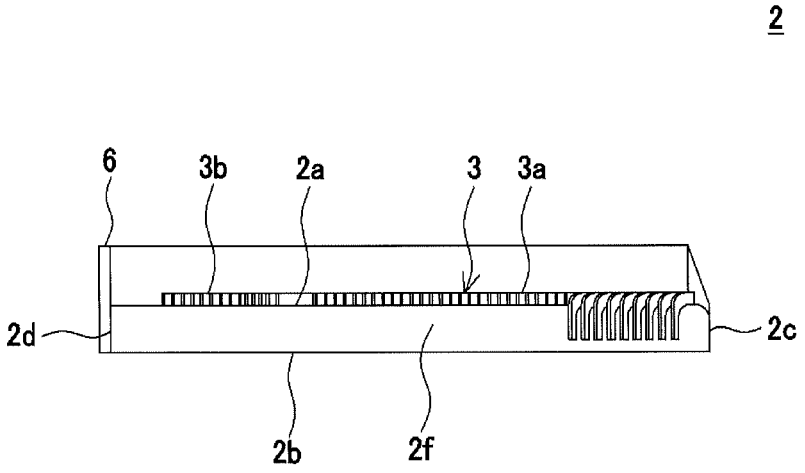
FIG. 7 is a left side view illustrating the shaking table according to the first example.
Figure 8:
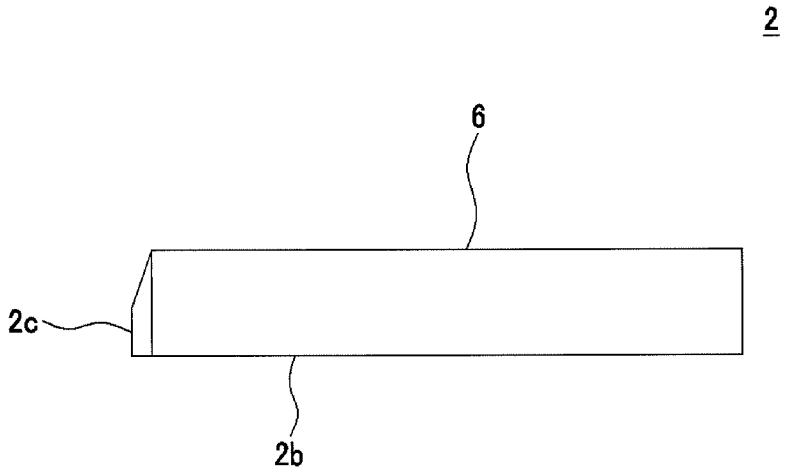
FIG. 8 is a right side view illustrating the shaking table according to the first example.
Figure 9:
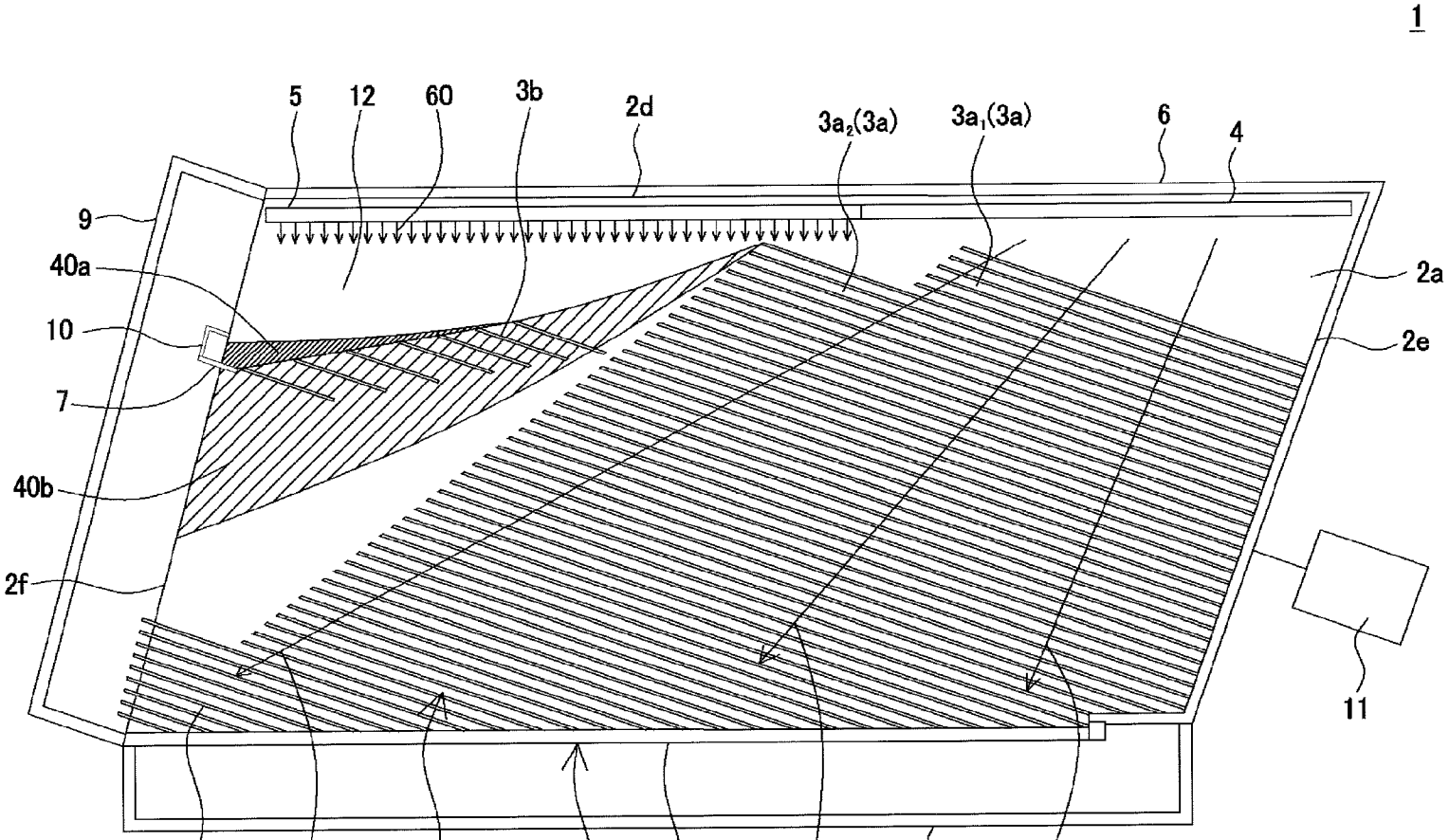
FIG. 9 is a plan view illustrating a table gravity concentrator according to a second example.
Figure 10:
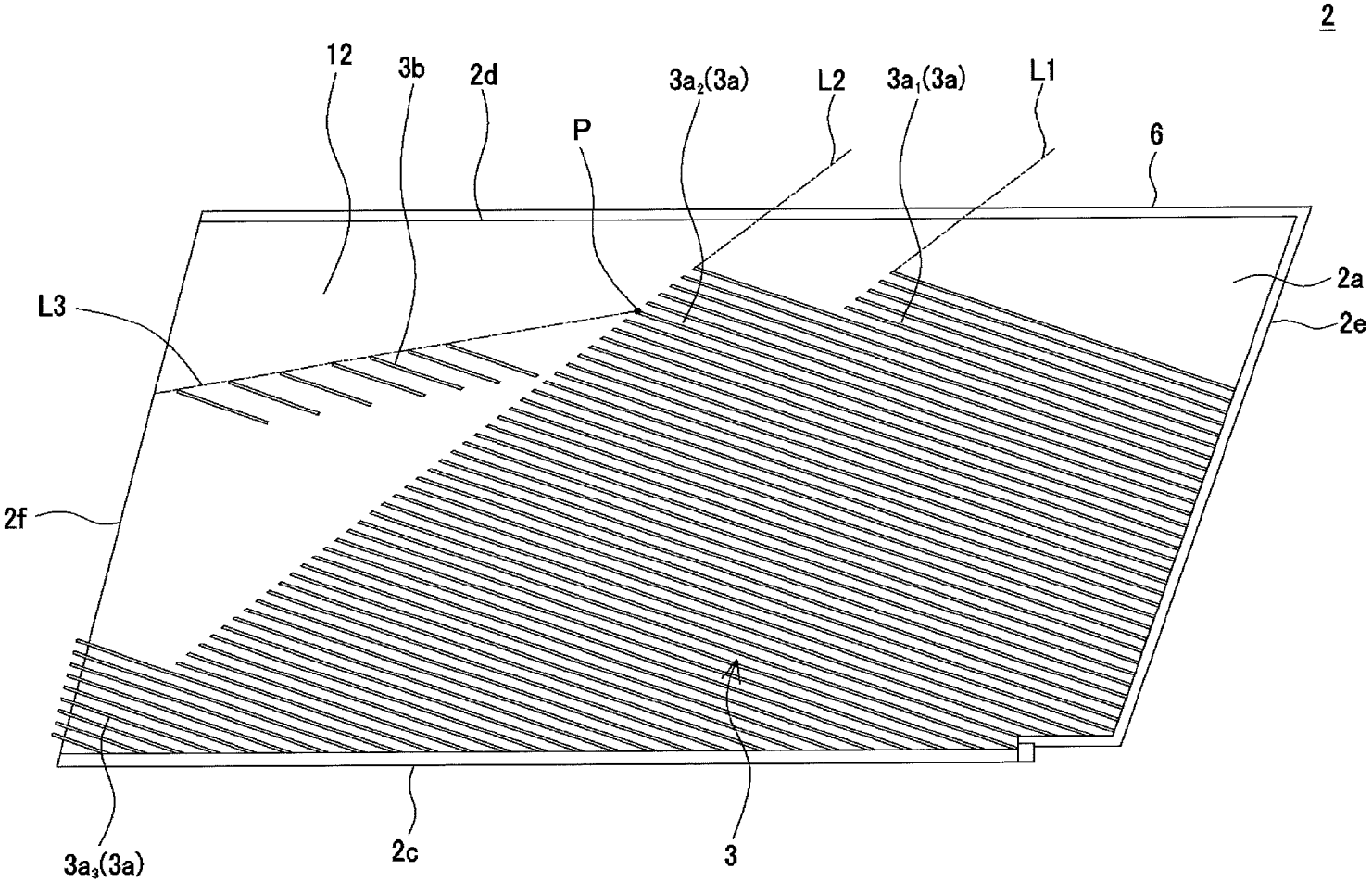
FIG. 10 is a plan view illustrating a shaking table according to the second example.
Figure 11:
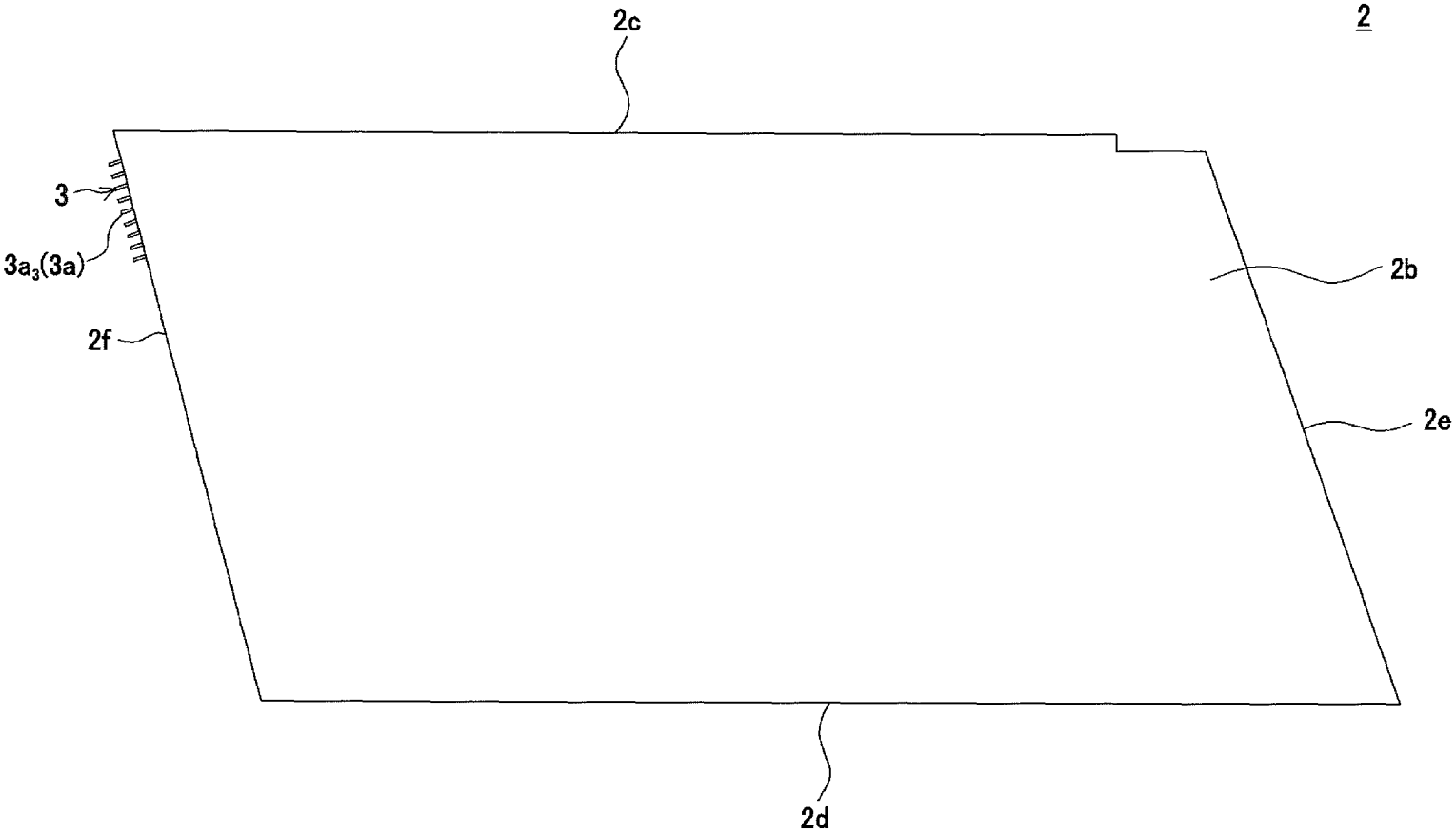
FIG. 11 is a bottom view illustrating the shaking table according to the second example.
Figure 12:
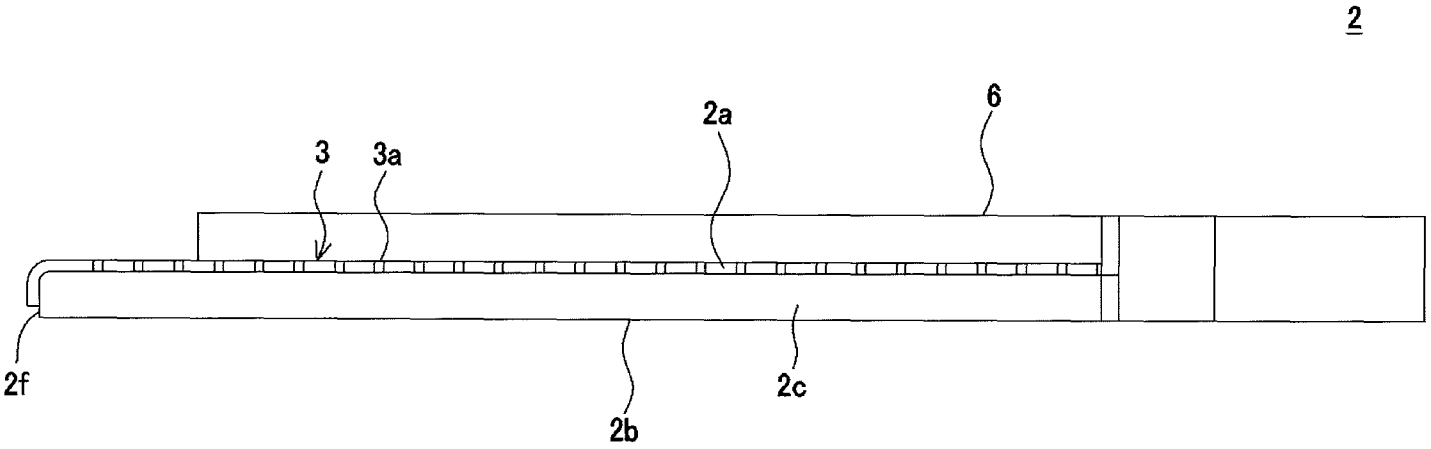
FIG. 12 is a front view illustrating the shaking table according to the second example.
Figure 13:
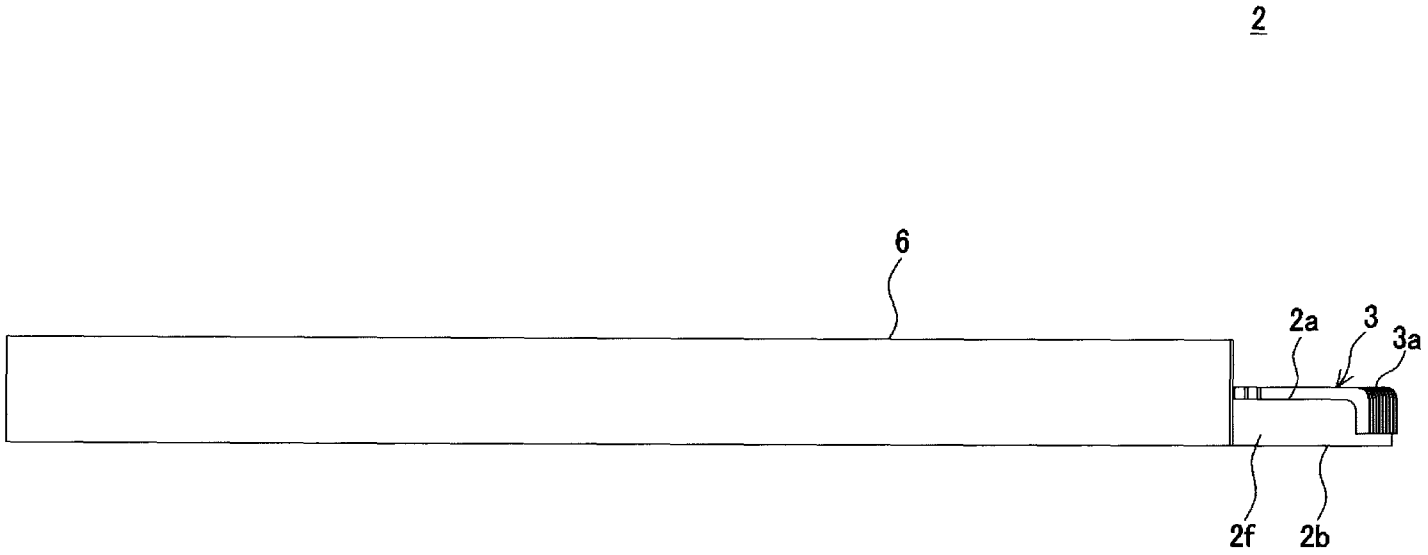
FIG. 13 is a back view illustrating the shaking table according to the second example.
Figure 14:
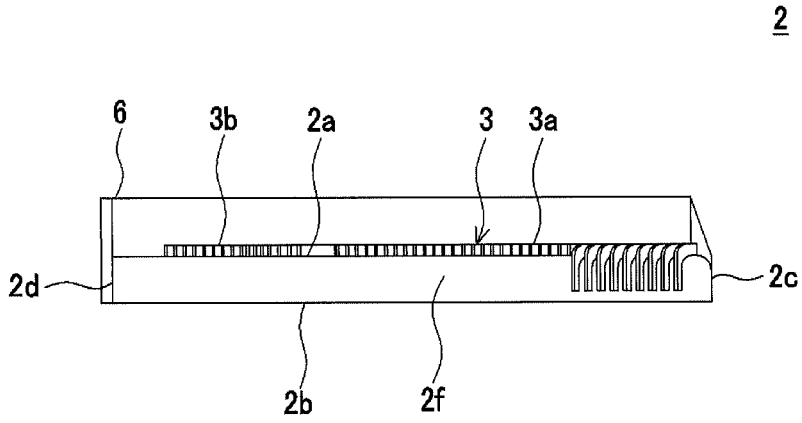
FIG. 14 is a left side view illustrating the shaking table according to the second example.
Figure 15:
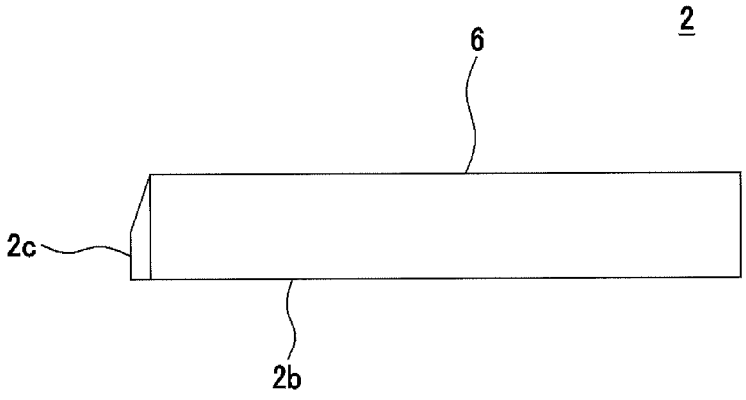
FIG. 15 is a right side view illustrating the shaking table according to the second example.
Figure 16:
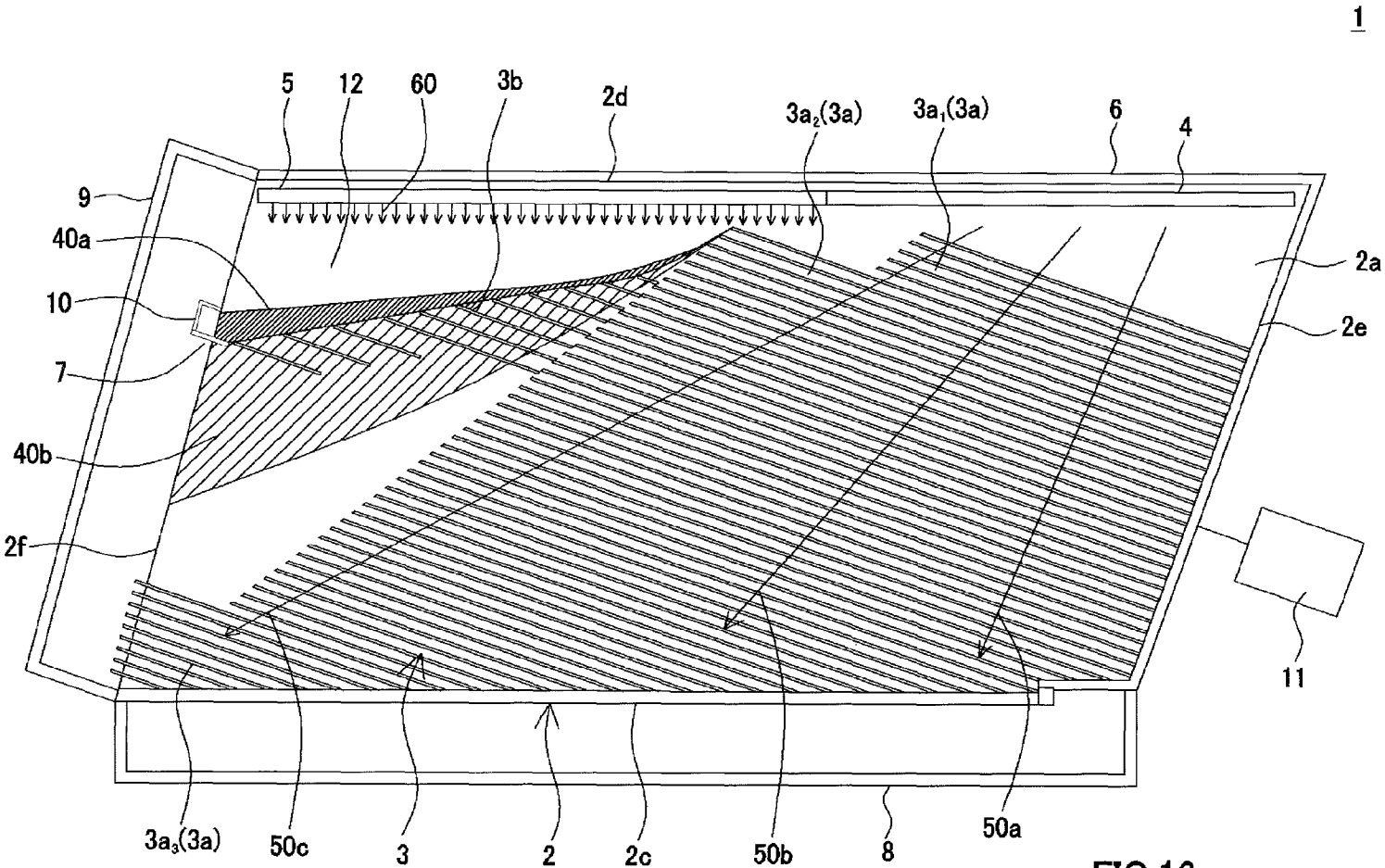
FIG. 16 is a plan view illustrating a table gravity concentrator according to a third example.
Figure 17:
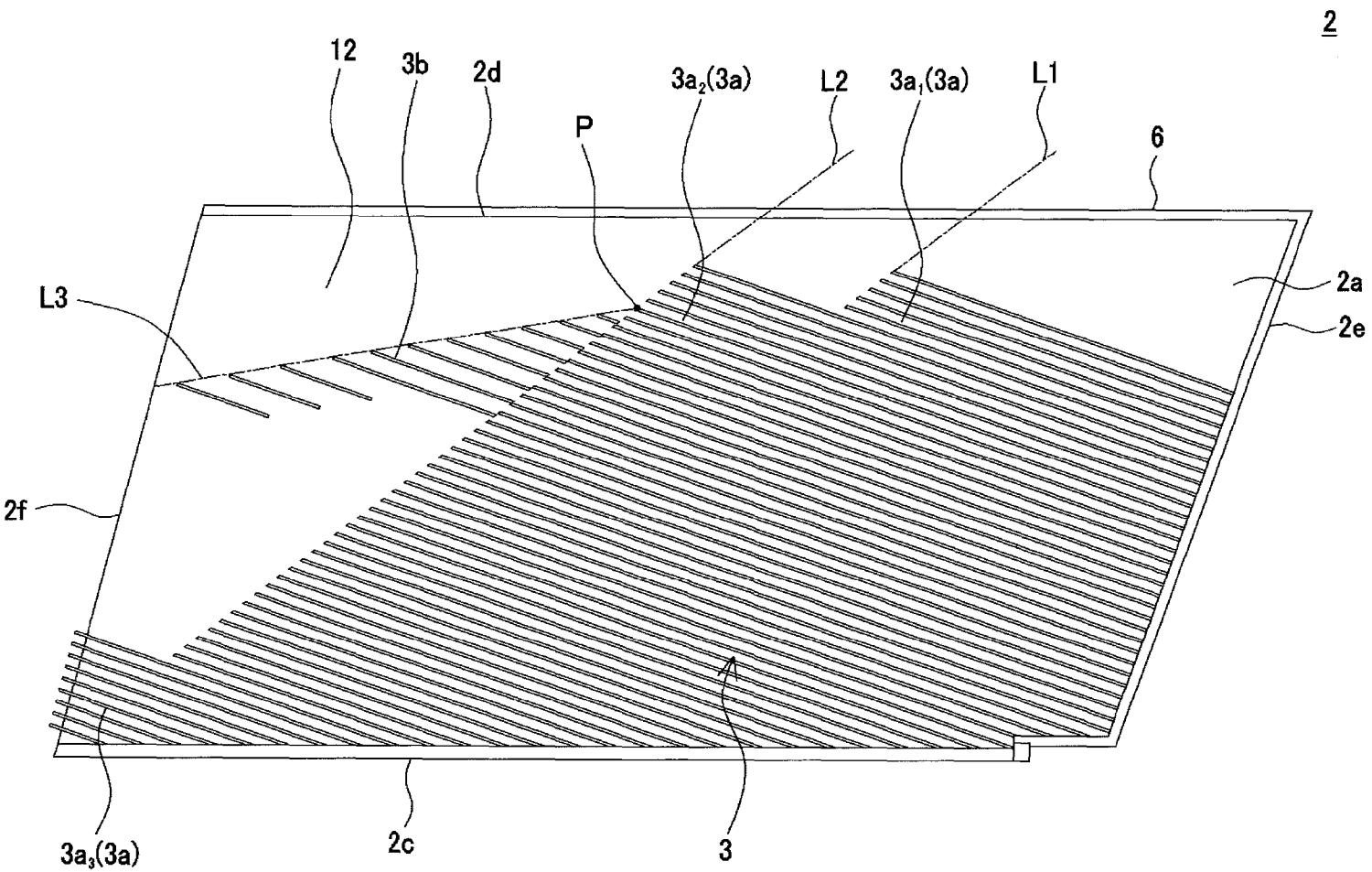
FIG. 17 is a plan view illustrating a shaking table according to the third example.
Figure 18:
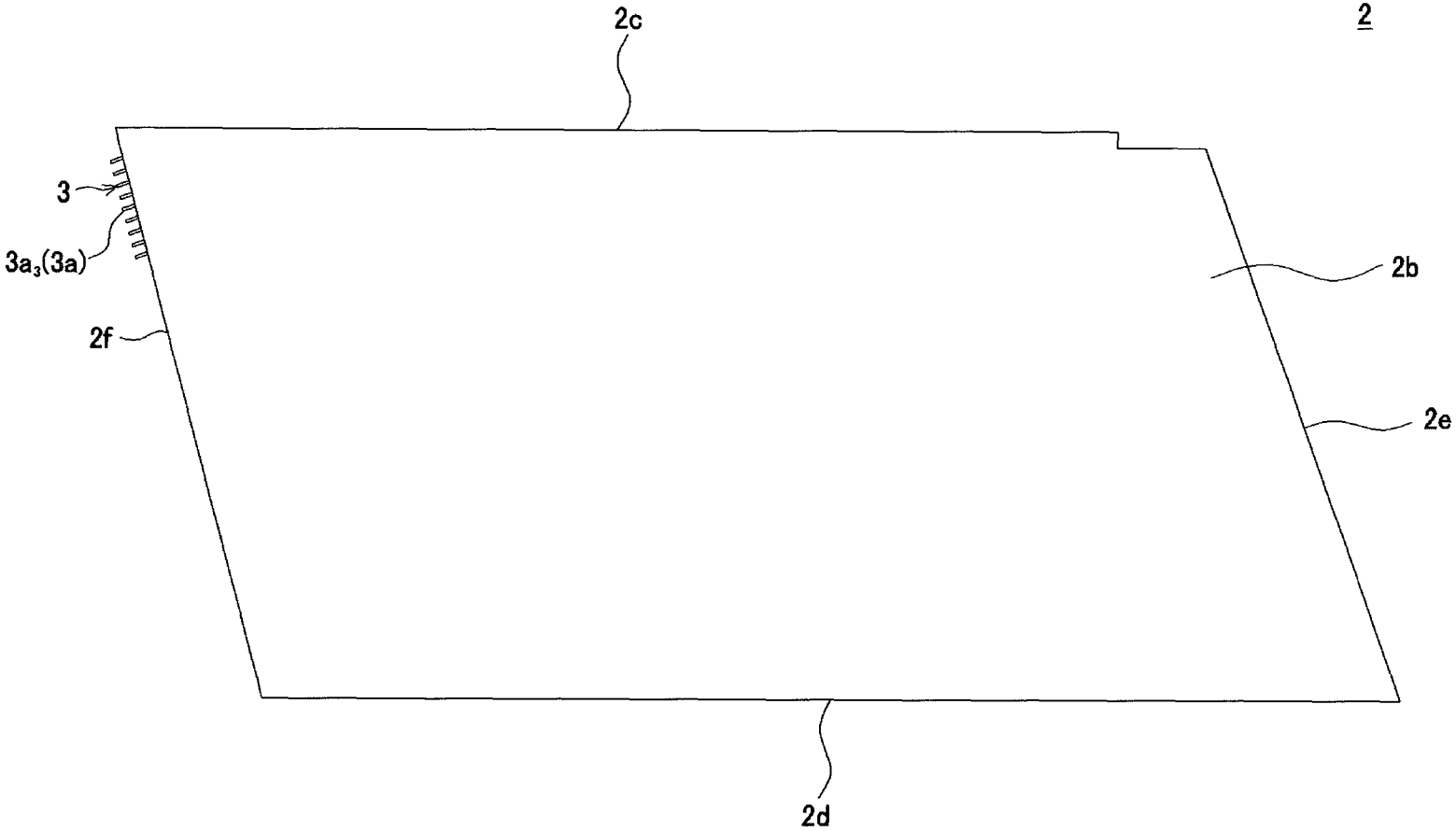
FIG. 18 is a bottom view illustrating the shaking table according to the third example.
Figure 19:
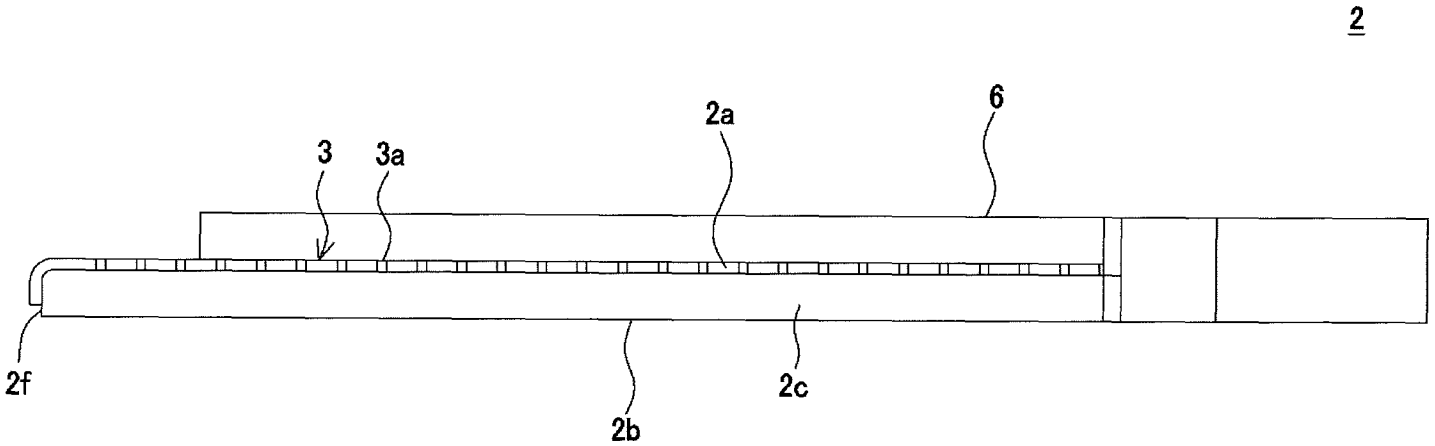
FIG. 19 is a front view illustrating the shaking table according to the third example.
Figure 20:
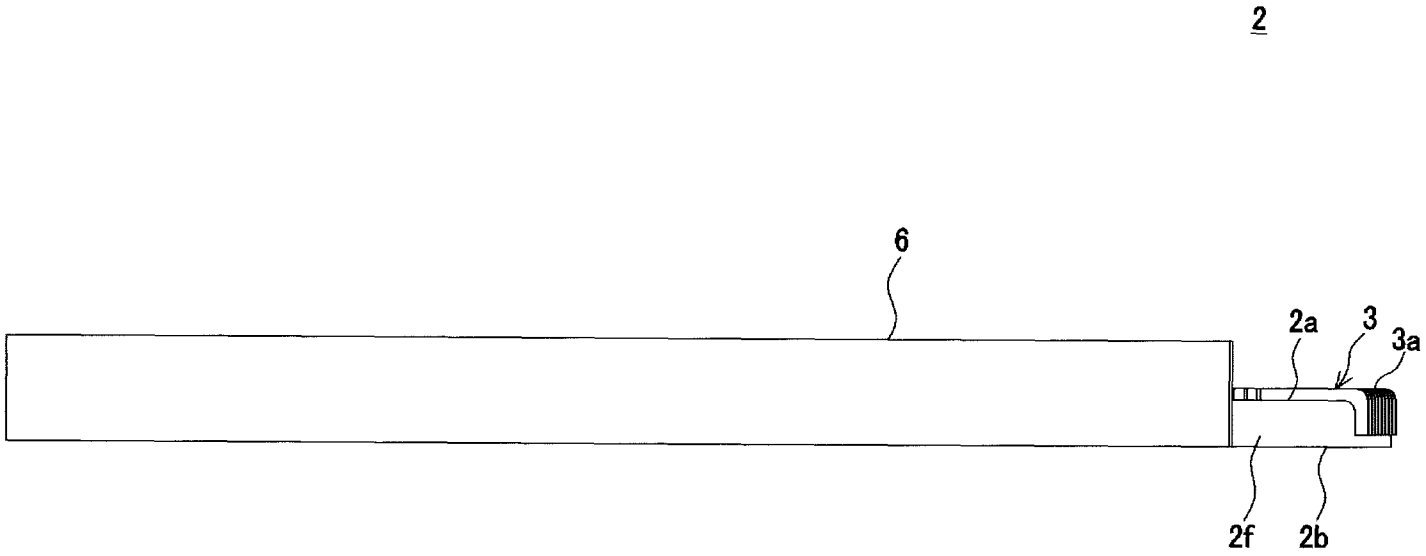
FIG. 20 is a back view illustrating the shaking table according to the third example.
Figure 21:
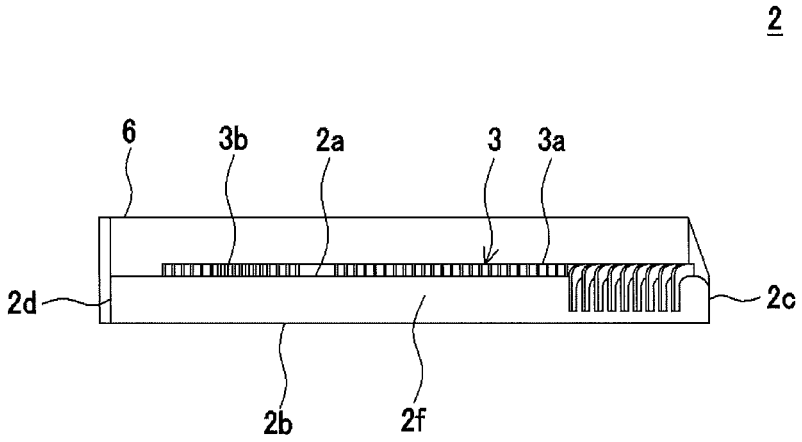
FIG. 21 is a left side view illustrating the shaking table according to the third example.
Figure 22:
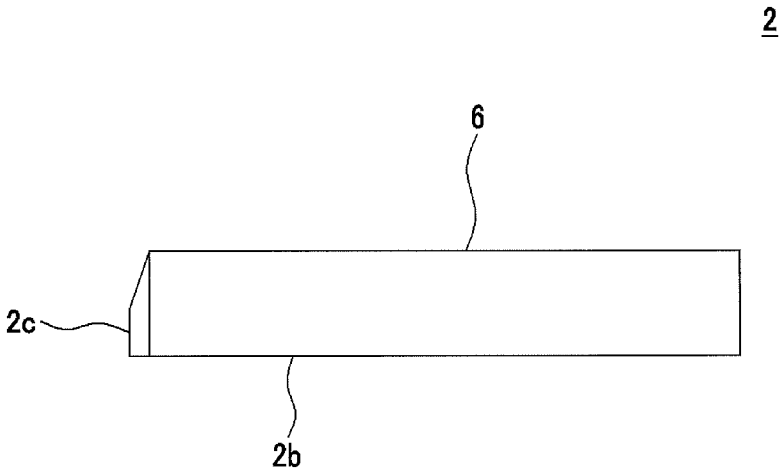
FIG. 22 is a right side view illustrating the shaking table according to the third example.

As illustrated in FIGS. 1 and 2, a table gravity concentrator 1 functioning as a gold concentrate recovery system includes a shaking table 2 provided with riffles 3, an ore supply launder 4 through which ore slurry is supplied to an upper surface 2*a* of the shaking table 2, a water supply launder 5 through which additive water is supplied to the upper surface 2*a* of the shaking table 2, a dam 6 for damming up the ore slurry supplied from the ore supply launder 4 and the additive water supplied from the water supply launder 5 so as to prevent the ore slurry and the additive water from falling from the upper surface 2*a* of the shaking table 2, a partition plate 7 for separating gold concentrates from tailings, first and second tailing recovery storage tanks 8 and 9 into which tailings are recovered, and a concentrate recovery storage tank 10 into which gold concentrates are recovered.

As illustrated in FIGS. 1 and 2, the shaking table 2 is constituted by a wooden plate component or the like having a parallelogrammatic shape in the plan view, or a plate component in which a wooden plate component is laminated on a metal plate component, for example. An example of the shaking table 2 is a plate unit parallelogrammatically shaped in the plan view, and sized to have a length of 99.8 inches in the length direction between a right side surface 2*e* and a left side surface 2*f*, and a length of 52.5 inches in the width direction between a front side surface 2*c* and a rear side surface 2*d* (the width direction is perpendicular to the length direction), a length of 4 inches in the thickness direction between the upper surface 2*a* and a lower surface 2*b*, and an angle of 70.5 degrees formed by the front side surface 2*c* and the left side surface 2*f*. The foregoing respective lengths and angles and other conditions of the shaking table 2 are presented by way of example only, and may be arbitrarily varied as necessary.

As illustrated in FIGS. 1 and 2, a plurality of riffles 3 projecting upward are provided on the upper surface 2*a* of the shaking table 2. The riffles 3 are disposed throughout the upper surface 2*a* of the shaking table 2 other than an area around the left rear corner of the upper surface 2*a* and the rear side surface 2*d* of the shaking table 2, for example. In addition, the riffles 3 are disposed on the upper surface 2*a* of the shaking table 2 with a predetermined angle formed by the riffles 3 and the length direction (width direction) of the shaking table 2. The riffles 3 will be detailed later.

As illustrated in FIGS. 1 and 2, the shaking table 2 is supported on a support table (not shown) in such a condition as to oscillate via an oscillation support mechanism (not shown) such as rails, for example, and is oscillated in the extension direction of the riffles 3 by a shaking driving mechanism 11. Moreover, the rear side surface 2*d* of the shaking table 2 is positioned higher than the front side surface 2*c* such that the upper surface 2*a* has a slope (inclination). For example, the upper surface 2*a* of the shaking table 2 is so disposed as to have a slope (inclination) of 6 degrees with respect to the horizontal plane. The foregoing angle and other conditions of the shaking table 2 are presented by way of example only, and may be arbitrarily varied as necessary.

As illustrated in FIGS. 1 and 2, the ore supply launder 4 is provided on the upper surface 2*a* of the shaking table 2 on the rear side surface 2*d* side and closer to the right side surface 2*e* side. The ore supply launder 4 is attached to the dam 6, for example, and successively supplies ore slurry to the upper surface 2*a* of the shaking table 2. The ore slurry is produced by pulverizing gold ores into the ore particles and additive water thereto. The ore slurry supplied from the ore supply launder 4 flows from the right rear corner of the upper surface 2*a* of the shaking table 2 toward the front side surface 2*c*, the left front corner of the upper surface 2*a*, the left side surface 2*f* or other areas in accordance with the slope (inclination) of the upper surface 2*a* of the shaking table 2, and the specific gravity and particle diameters of the ore particles contained in the ore slurry, as indicated by arrows 50*a*, 50*b*, and 50*c* in FIG. 2.

As illustrated in FIGS. 1 and 2, the water supply launder 5 is provided on the upper surface 2*a* of the shaking table 2 on the rear side surface 2*d* side and closer to the left surface side 2*f* side. The water supply launder 5 is attached to the dam 6 at a position adjacent to the left side surface 2*f* side of the ore supply launder 4, for example, and successively supplies additive water to the upper surface 2*a* of the shaking table 2. The additive water supplied from the water supply launder 5 flows from the rear side surface 2*d* side of the shaking table 2 toward the front side surface 2*c* side (width direction of the shaking table 2) in accordance with the slope (inclination) of the upper surface 2*a* of the shaking table 2, as indicated by arrows 60 in FIG. 2.

The ore supply launder 4 and the water supply launder 5 may be formed integrally with each other and constitute a launder unit. The ore supply launder 4 and the water supply launder 5 are not limited to be attached to the dam 6. Alternatively, the ore supply launder 4 and the water supply launder 5 may be attached to the shaking table 2, or other constituent elements of the table gravity concentrator 1.

As illustrated in FIGS. 1 and 2, the wall-shaped dam 6 is provided on the rear side surface 2*d*, the right side surface 2*e*, and a part of the front side surface 2*c* on the right side surface 2*e* side of the shaking table 2. The dam 6 is attached to the respective side surfaces 2*d*, 2*e*, and 2*c* of the shaking table 2 in such a manner that the upper end of the dam 6 projects upward from the upper surface 2*a* of the shaking table 2. For example, the dam 6 is sized to have a width of 1 inch, a length of 9 inches in the thickness direction between the upper surface 2*a* and the lower surface 2*b* of the shaking table 2, and is so attached to the respective side surfaces 2*d*, 2*e*, and 2*c* of the shaking table 2 as to project from the upper surface 2*a* of the shaking table 2 by 5 inches. According to this structure, the ore slurry supplied from the ore supply launder 4 to the upper surface 2*a* of the shaking table 2, and the additive water supplied from the water supply launder 5 to the upper surface 2*a* of the shaking table 2 are prevented from falling from the rear side surface 2*d* and the right side surface 2*e* of the shaking table 2 by the function of the dam 6. The foregoing width, the length, the projection and other conditions of the dam 6 are presented by way of example only, and may be arbitrarily varied as necessary.

As illustrated in FIGS. 2 through 8, the plural riffles 3 are provided throughout the upper surface 2*a* of the shaking table 2 other than the area around the left rear corner of the upper surface 2*a* and the rear side surface 2*d* of the shaking table 2, for example. The riffles 3 are disposed on the upper surface 2*a* of the shaking table 2 with a predetermined angle formed by the riffles 3 and the length direction (width direction) of the shaking table 2. The riffles 3 are constituted by first riffles 3*a* and second riffles 3*b*.

As illustrated in FIGS. 2 through 8, each of the first riffles 3*a* is formed by a long member, for example. A plurality of the first riffles 3*a* are disposed on the upper surface 2*a* of the shaking table 2 at uniform intervals while inclined at a predetermined angle with respect to the length direction (front side surface 2*c*) of the shaking table 2. For example, each of the first riffles 3*a* is a long member having a width of 0.3 inch, and a length of 1 inch in the thickness direction between the upper surface 2*a* and the lower surface 2*b* of the shaking table 2. The sixty first riffles 3*a* are disposed on the upper surface 2*a* of the shaking table 2 at uniform intervals while inclined at 19.5 degrees toward the rear side surface 2*d* of the shaking table 2 with respect to the length direction (front side surface 2*c*) of the shaking table 2, in other words, inclined at 90 degrees with respect to the right side surface 2*e* (left side surface 2*f*) of the shaking table 2. The foregoing thickness, the length, the angle, the number and other conditions of the first riffle 3*a* are presented by way of example only, and may be arbitrarily varied as necessary.

The first riffles 3*a* are constituted by upstream riffles $3a_1$, midstream riffles $3a_2$, and downstream riffles $3a_3$. The upstream riffles $3a_1$, midstream riffles $3a_2$, and downstream riffles $3a_3$ are disposed in this order on the upper surface 2*a* of the shaking table 2 from the rear side surface 2*d* side toward the front side surface 2*c* side of the shaking table 2. Each unit of the upstream riffles $3a_1$, midstream riffles $3a_2$, and downstream riffles $3a_3$ is constituted by a plurality of riffles.

The upstream riffles $3a_1$ are so provided as to gradually increase in length from the rear side surface 2*d* toward the front side surface 2*c* of the shaking table 2. For example, the upstream riffles $3a_1$ are so provided that a line L1 connecting the left side surface 2*f* side tips of the upstream riffles $3a_1$ is inclined at an angle of 37.4 degrees toward the rear side surface 2*d* with respect to the length direction of the shaking table 2, that is, inclined at an angle of 52.6 degrees toward the right side surface 2*e* with respect to the width direction of the shaking table 2. In other words, the upstream riffles $3a_1$ are so provided that an angle of 123.1 degrees is formed by the extension direction of the midstream riffles $3a_2$ and the line L1 connecting the tips of the upstream riffles $3a_1$.

The midstream riffles $3a_2$ are longer than the upstream riffles $3a_1$ in the extension direction. Similarly to the upstream riffles $3a_1$, the midstream riffles $3a_2$ are so provided as to gradually increase in length from the rear side surface 2*d* toward the front side surface 2*c* of the shaking table 2. For example, similarly to the upstream riffles $3a_1$, the midstream riffles $3a_2$ are so provided that a line L2 connecting the left side surface 2*f* side tips of the midstream riffles $3a_2$ is inclined at an angle of 37.4 degrees toward the rear side surface 2*d* with respect to the length direction of the shaking table 2, that is, inclined at an angle of 52.6 degrees toward the right side surface 2*e* with respect to the width direction of the shaking table 2. In other words, the midstream riffles $3a_2$ are so provided that an angle of 123.1 degrees is formed by the extension direction of the downstream riffles $3a_3$ and the line L2 connecting the tips of the midstream riffles $3a_2$. Accordingly, the line L2 connecting the tips of the midstream riffles $3a_2$ is so defined as to become parallel with the line L1 connecting the tips of the upstream riffles $3a_1$.

The downstream riffles $3a_3$ extend from the upper surface 2*a* toward the left side surface 2*f* of the shaking table 2.

The foregoing angles of the line L1 connecting the tips of the upstream riffles $3a_1$ and L2 connecting the tips of the midstream riffles $3a_2$ are presented by way of example only and not limited to these. These angles of the likes L1 and L2 may be arbitrarily varied as necessary. Moreover, the angles of the line L1 connecting the tips of the upstream riffles $3a_1$ and L2 connecting the tips of the midstream riffles $3a_2$ are not required to be the same. These angles of the lines L1 and L2 may be set different from each other.

A flat area 12 is provided at the left rear corner of the upper surface 2*a* of the shaking table 2. The flat area 12 is an area where the first riffles 3*a* are not formed. The flat area 12 has a substantially triangular shape in the plan view. As illustrated in FIG. 2, a first gold line 40*a* is generated in the flat area 12 when ore particles constituted by gold ores and supplied together with the additive water are concentrated by the first riffles 3*a* based on specific gravity of the ore particles. For example, the first gold line 40*a* is generated from the left side surface 2*f* side tip of the midstream riffle $3a_2$ located at the position closest to the rear side surface 2*d* side (uppermost row) in the first riffle 3*a*, and extends toward the flat area 12 of the shaking table 2. The first gold line 40*a* in the flat area 12 flows toward the left side surface 2*f* of the shaking table 2.

As illustrated in FIGS. 2 through 8, each of the second riffles 3*b* is constituted by a long member similarly to the first riffle 3*a*, for example. The second riffles 3*b* are disposed on the downstream side of the flow of the additive water, and on the downstream side of the stream of the first gold line 40*a* with respect to the position where the first gold line 40*a* starts appearing in the flat area 12 of the shaking table 2. A plurality of the second riffles 3*b* are provided on the flat area 12 of the shaking table 2 at uniform intervals or non-uniform intervals while inclined at a predetermined angle with respect to the length direction (front side surface 2*c*) of the shaking table 2, such that the second riffles 3*b* become parallel with the first riffles 3*a*.

For example, each of the second riffles 3*b* is constituted by a long member having a width of 0.3 inch, a length of 1 inch in the thickness direction between the upper surface 2*a* and the lower surface 2*b* of the shaking table 2, and a length of 9 inches in the extension direction. The second riffles 3*b* are disposed on the flat area 12 of the shaking table 2 on the front side surface 2*c* side of the shaking table 2 and on the left side surface 2*f* side of the shaking table 2 with respect to the of the riffle on the uppermost row of the midstream riffles $3a_2$ in the first riffles 3*a*, from which position of the tip of the uppermost riffle $3a_2$ the first gold line 40*a* is generated. The five second riffles 3*b* are provided on the flat area 12 of the shaking table 2 while inclined at 19.5 degrees toward the rear side surface 2*d* side of the shaking table 2 with respect to the length direction (front side surface 2*c*) of the shaking table 2, in other words, inclined at 90 degrees with respect to the right side surface 2*e* (left side surface 2*f*) of the shaking table 2.

The second riffles 3*b* are disposed such that a line L3 connecting the left side surface 2*f* side tips of the second riffles 3*b* is inclined at an angle of 10.1 degrees toward the rear side surface 2*d* with respect to the length direction of the shaking table 2, that is, inclined at an angle of 79.9 degrees toward the right side surface 2*e* with respect to the width direction of the shaking table 2. In other words, the second riffles 3*b* are disposed such that an angle of 27.3 degrees is formed by the line L2 connecting the tips of the midstream riffles $3a_2$ and the line L3 connecting the tips of the second riffles 3*b*.

The foregoing width, the length, the angle, the number and other conditions of the second riffles 3*b* are presented by way of example only and not limited to these. These may be arbitrarily varied as necessary. Moreover, the first gold line 40*a* is not limited to be generated from the tip of the riffle on the uppermost row of the midstream riffles $3a_2$ of the first riffles 3*a*, but may be generated from a riffle on a row shifted by several rows from the uppermost row. In this case, the second riffles 3*b* are disposed on the flat area 12 of the shaking table 2 on the front side surface 2*c* side of the shaking table 2 and on the left side surface 2*f* side of the shaking table 2 with respect to the tip of the corresponding riffle on the row shifted by several rows from the uppermost row. More specifically, an intersection P of the line L3 connecting the tips of the second riffles 3*b* and the line L2 connecting the tips of the midstream riffles $3a_2$ of the first riffles 3*a* is located on the front side surface 2*c* side of the shaking table 2 with respect to the tip of the corresponding riffle on the row shifted by several rows from the uppermost row.

The riffles 3 thus constructed are formed on the upper surface 2*a* of the shaking table 2 in the manner as follows, for example. Long members made of rubber or resin and constructed in correspondence with the foregoing first riffles 3*a* and the second riffles 3*b* are affixed to a body sheet formed by a rubber sheet or a resin sheet slightly larger than the shaking table 2. Then, the body sheet to which the first riffles 3*a* and the second riffles 3*b* are attached is placed on the upper surface 2*a* of the wooden shaking table 2 and attached to the upper surface 2*a* by staples or the like to form the riffles 3 on the upper surface 2*a* of the shaking table 2. For example, the body sheet and the long members, that is, the riffles 3, are made of linoleum.

The table gravity concentrator 1 thus constructed recovers gold concentrates from gold ores containing gangue minerals or sulfide minerals in the manner as follows.

Initially, as illustrated in FIG. 2, the shaking table 2 of the table gravity concentrator 1 is oscillated by the shaking driving mechanism 11 in the extension direction of the riffles 3. Ore slurry is successively supplied from the ore supply launder 4 to the upper surface 2*a* of the shaking table 2 of the table gravity concentrator 1, while additive water is successively supplied from the water supply launder 5 to the upper surface 2*a* of the shaking table 2.

As a result, among the ore slurry supplied to the upper surface 2*a* of the shaking table 2, low specific gravity ore particles having low specific gravity such as gangue minerals and sulfide minerals receive resistance of water flow of the additive water flowing in the width direction of the shaking table 2, and flows in the water flow direction of the additive water (width direction of the shaking table 2) while going over the first riffles 3*a* independently from the oscillation movement of the shaking table 2. Then, the low specific gravity ore particles fall from the front side surface 2*c* of the shaking table 2, and are recovered as tailings into the first tailing recovery storage tank 8 provided on the front side surface 2*c* side of the shaking table 2 together with the additive water.

On the other hand, high specific gravity ore particles having high specific gravity shift in the extension direction along the first riffles 3*a* in accordance with the oscillation movement of the shaking table 2. Then, the high specific gravity ore particles flow into the flat area 12 from the tip of the riffle on the uppermost row of the midstream riffles $3a_2$ of the first riffles 3*a*, for example.

In this case, the high specific gravity and large particle diameter ore particles flowing in the flat area 12 are more likely to shift in the water flow direction of the additive water by the flow of the additive water from the water supply launder 5 than the high specific gravity and small particle diameter ore particles when the specific gravity of the large diameter particles and the small diameter particles are the same. Accordingly, the stream (first gold line) 40*a* of high specific gravity, small particle diameter, and high gold grade ore particles, and a stream (tailing layer) 40*b* of high specific gravity and large particle diameter ore particles are formed in the flat area 12. Furthermore, a part of the high specific gravity and large particle diameter gold ore particles shift in the water flow direction of the additive water during flow in the flat area 12 by the flow of the additive water from the water supply launder 5 or by others, and form a stream (second gold line) other than the first gold line 40*a*. However, according to the table gravity concentrator 1 provided with the second riffles 3*b* on the flat area 12, the high specific gravity and large particle diameter gold ore particles receiving the resistance of the water flow of the additive water and shifting in the water flow direction of the additive water on the flat area 12 are returned to the first gold line 40*a* by the second riffles 3*b*. Accordingly, the amount of gold ore particles constituted by the high specific gravity and large particle diameter gold ore particles and flowing along the second gold line is reduced to a smaller amount than the corresponding amount in the conventional method, or is reduced to none.

Then, the table gravity concentrator 1 separates the first gold line 40*a* from the tailing layer 40*b* using the partition plate 7 provided on the left side surface 2*f* of the shaking table 2 in such a condition as to freely shift along the left side surface 2*f*, for example. Subsequently, the table gravity concentrator 1 recovers the first gold line 40*a* together with the additive water into the concentrate recovery storage tank 10 provided on the left side surface 2*f* side of the shaking table 2. Furthermore, the table gravity concentrator 1 recovers the tailing layer 40*b* together with the additive water into the second tailing recovery storage tank 9 provided on the left side surface 2*f* side of the shaking table 2.

By this method, the table gravity concentrator 1 recovers gold concentrates from gold ores containing gangue minerals or sulfide minerals.

According to the table gravity concentrator 1, therefore, the first riffles 3*a* are disposed on the upper surface 2*a* of the shaking table 2 to concentrate ore particles based on specific gravity of the ore particles. The ore particles are constituted by gold ores and supplied together with additive water. Moreover, the second riffles 3*b* are disposed on the upper surface 2*a* of the shaking table 2 in the flat area 12, which is an area where the first riffles 3*a* are not disposed and an area where the first gold line 40*a* is generated, on the downstream side of flow of the additive water and on the downstream side of the stream of the first gold line 40*a* with respect to the position where the first gold line 40*a* starts appearing in the flat area 12. Accordingly, the second riffles 3*b* of the table gravity concentrator 1 return, again to the first gold line 40*a*, the gold ore particles shifted toward the downstream side of the flow of the additive water in the flat area 12 by the flow of the additive water and separated from the first gold line 40*a*. In this case, the table gravity concentrator 1 recovers not only high specific gravity and small particle diameter gold ore particles, but also high specific gravity and large particle diameter gold ore particles not as tailings as recovered in the conventional method, but as concentrates. Thus, efficient recovery of gold ore particles is achievable.

Moreover, according to the table gravity concentrator 1, the second riffles 3*b* are positioned on the downstream side of the flow of the additive water and on the downstream side of the stream of the first gold line 40*a* with respect to the position where the first gold line 40*a* starts appearing in the flat area 12. In this case, the first gold line 40*a* flows along the second riffles 3*b*, wherefore the first gold line 40*a* becomes more linear and deviation and winding of the first gold line 40*a* are reduced. Accordingly, the table gravity concentrator 1 decreases, more than the conventional method, the possibility that ore particles which should be recovered as concentrates are recovered as tailings, and the possibility that ore particles which should be recovered as tailings are recovered as concentrates. This advantage can reduce errors produced in separating the stream (first gold line) 40*a* of high specific gravity, small particle diameter, and high gold grade ore particles from the stream (tailing layer) 40*b* of high specific gravity and large particle diameter ore particles, and allow efficient and stable recovery of gold ore particles. Furthermore, according to the table gravity concentrator 1, the first gold line 40*a* flows along the second riffles 3*b* and becomes more linear as discussed above. This advantage can reduce the labor of shifting the partition plate 7 in accordance with deviation and winding of the first gold line 40*a* while monitoring the first gold line 40*a* during operation, or eliminate this labor to none, when the partition plate 7 is positioned on an extension line of the line L3 connecting the tips of the second riffles 3*b*, for example. Accordingly, efficient and stable recovery of gold ore particles is achievable.

The number of the second riffles 3*b* provided on the flat area 12 is not limited to five. The number of the second riffles 3*b* to be provided on the flat area 12 may be different numbers as long as the second riffles 3*b* can return high specific gravity and large particle diameter gold ore particles separated from the first gold line 40*a* again to the first gold line 40*a*. For example, as illustrated in FIGS. 9 through 15, the seven second riffles 3*b* in total may be provided on the flat area 12 by addition of the two second riffles 3*b* on the front side surface 2*c* side of the shaking table 2 shown in FIGS. 2 through 8. The second riffles 3*b* thus constructed can return a larger amount of the high specific gravity and large particle diameter gold ore particles separated from the first gold line 40*a* again to the first gold line 40*a* with increase in the number of the second riffles 3*b* to be provided. Accordingly, this structure can recover a larger amount of gold ore particles. Moreover, the second riffles 3*b* are disposed on a wider range of the flat area 12 with increase in the number of the second riffles 3*b* to be provided. In this case, the first gold line 40*a* becomes more linear, and deviation or winding of the first gold line 40*a* are reduced. Accordingly, more efficient and stable recovery of gold ore particles is achievable.

As illustrated in FIGS. 16 through 22, the second riffles 3*b* may be disposed throughout the range from the first riffles 3*a* to the left side surface 2*f* of the shaking table 2. For example, as illustrated in FIGS. 16 through 22, the eleven second riffles 3*b* in total may be provided on the flat area 12 by addition of the four second riffles 3*b* on the rear side surface 2*d* side of the shaking table 2 shown in FIGS. 9 through 15. In this case, the second riffles 3*b* are disposed throughout the range from the first riffles 3*a* to the left side surface 2*f* of the shaking table 2 (partition plate 7). The second riffles 3*b* thus constructed can return a larger amount of high specific gravity and large diameter gold ore particles separated from the first gold line 40*a* again to the first gold line 40*a* with increase in the number of the second riffles 3*b* to be provided. Accordingly, this structure can recover a larger amount of gold ore particles than the case where the second riffles 3*b* are disposed on any part of the range in the flat area 12 from the first riffles 3*a* to the left side surface 2*f* of the shaking table 2. Furthermore, according to the structure where the second riffles 3*b* are disposed throughout the range in the flat area 12 from the first riffles 3*a* to the left side surface 2*f* of the shaking table 2, the first gold line 40*a* becomes more linear than in the case where the second riffles 3*b* are disposed on any part of the range in the flat area 12 from the first riffles 3*a* to the left side surface 2*f* of the shaking table 2. In this case, deviation and winding of the first gold line 40*a* are reduced. Accordingly, more efficient and stable recovery of gold ore particles is achievable.

The second riffles 3*b* are not limited to have a uniform length, but may have different lengths for each as illustrated in FIGS. 16 through 22.

As illustrated in FIGS. 16 through 22, the right side surface 2*e* side base ends of the second riffles 3*b* may be disposed on the line L2 connecting the tips of the midstream riffles $3a_2$ of the first riffles 3*a* such that spaces between the base ends of the second riffles 3*b* and the tips of the midstream riffles $3a_2$ of the first riffles 3*a* can be eliminated. For example, the base ends of the eight second riffles 3*b* positioned on the rows from the uppermost row to the eighth row may be disposed on the line L2 connecting the tips of the midstream riffles $3a_2$ of the first riffles 3*a*. According to this structure, no space is produced between the base ends of the second riffles 3*b* and the tips of the midstream riffles $3a_2$ of the first riffles 3*a*, in which condition falling of gold ore particles through spaces produced between these ends can be prevented. Moreover, even when high specific gravity and large particle diameter gold ore particles separated from the first gold line 40*a* go over one of the second riffles 3*b* thus constructed, the gold ore particles having gone over the corresponding one second riffle 3*b* can be returned to the first gold line 40*a* via the second riffles 3*b* disposed on the downstream side of the corresponding one second riffle 3*b*. Accordingly, the second riffles 3*b* thus constructed can recover a larger amount of gold ore particles than in the case where the second riffles 3*b* are positioned apart from the first riffles 3*a*.

Figure 23:
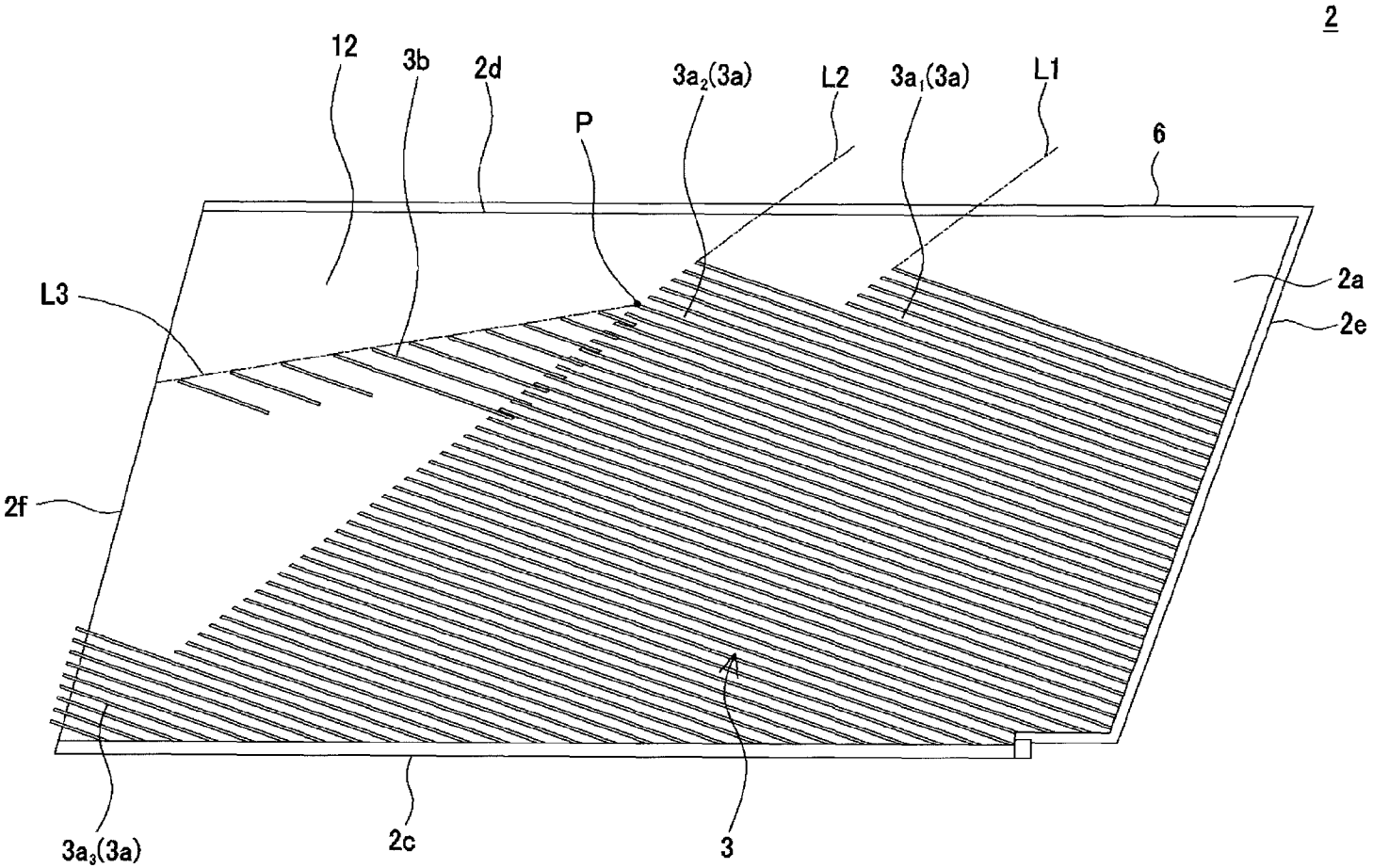
FIG. 23 is a plan view illustrating a shaking table according to a fourth example.
Figure 24:
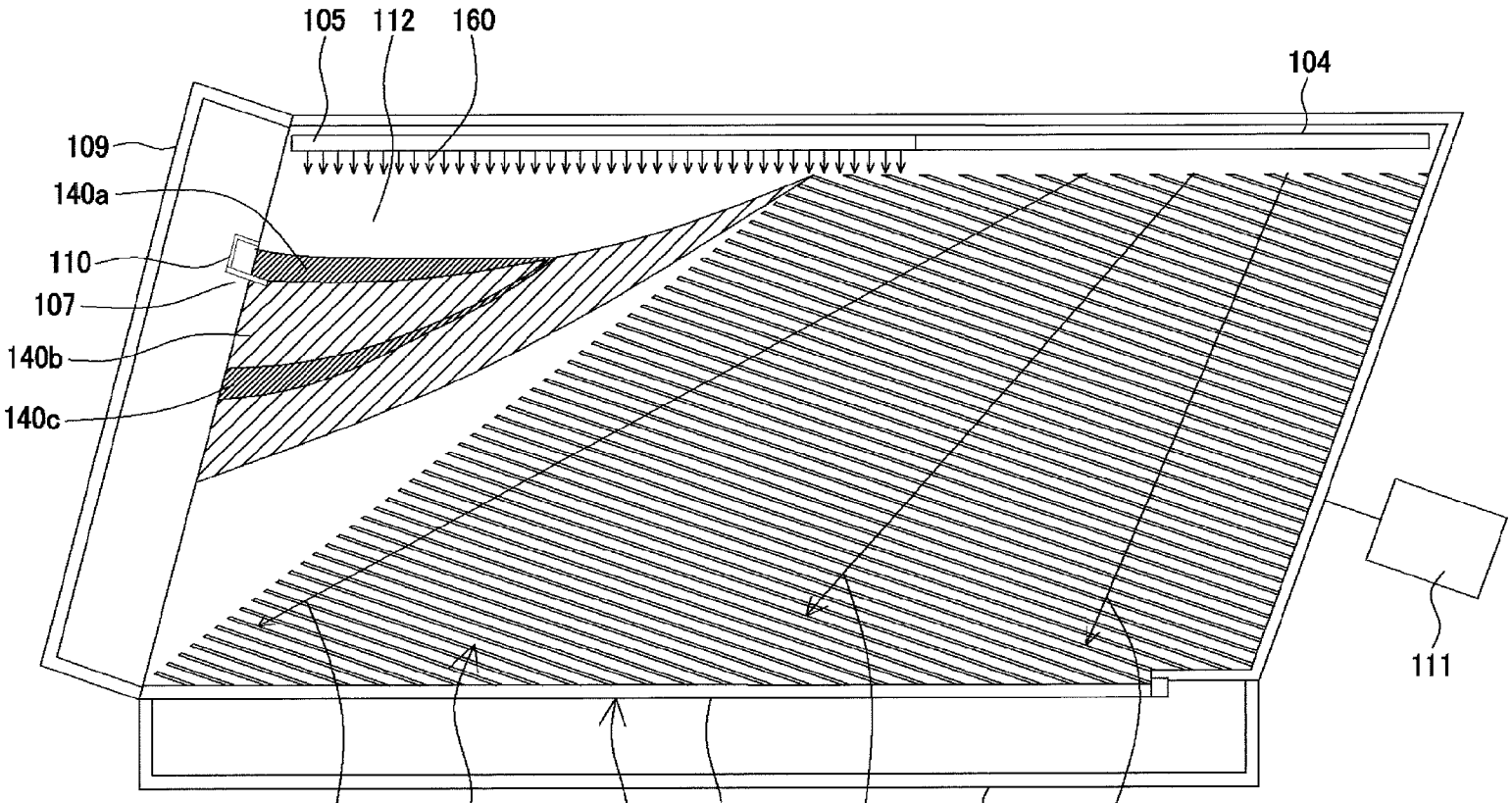
FIG. 24 is a plan view illustrating a conventional table gravity concentrator.

As illustrated in FIG. 23, the second riffles 3*b* may be disposed such that the base ends of the second riffles 3*b* are located on the right side surface 2*e* side with respect to the line L2 connecting the tips of the midstream riffles $3a_2$ of the first riffles 3*a*. In this case, each of the second riffles 3*b* is disposed between the midstream riffles $3a_2$ of the first riffles 3*a*. For example, the base ends of the eight second riffles 3*b* positioned on the rows from the uppermost row to the eighth row may be disposed on the right side surface 2*e* side with respect to the line L2 connecting the tips of the midstream riffles $3a_2$ of the first riffles 3*a*. According to this structure, the second riffles 3*b* are so disposed as to overlap with the first riffles 3*a*, in which condition falling of gold ore particles through spaces between the base ends of the second riffles 3*b* and the tips of the midstream riffles $3a_2$ of the first riffles 3*a* is prevented. Furthermore, even when high specific gravity and large particle diameter gold ore particles separated from the first gold line 40*a* go over one of the second riffles 3*b* so disposed as to overlap with the first riffles 3*a*, the gold ore particles having gone over the corresponding one second riffle 3*b* can be returned again to the first gold line 40*a* via the first riffles 3*a* and the second riffles 3*b* disposed on the downstream side of the corresponding one second riffle 3*b*. Accordingly, the second riffles 3*b* thus constructed can recover a larger amount of gold ore particles than the second riffles 3*b* disposed such that the base ends of the second riffles 3*b* are located on the line L2 connecting the tips of the midstream riffles $3a_2$ of the first riffles 3*a*.

A part or all of the second riffles 3*b* may be made higher than the first riffles 3*a* so as to eliminate the possibility that high specific gravity and large particle diameter gold ore particles separated from the first gold line 40*a* go over the second riffles 3*b*. According to this structure, going over the second riffles 3*b* becomes more difficult for high specific gravity and large particle diameter gold ore particles separated from the first gold line 40*a*. Accordingly, recovery of a larger amount of gold ore particles is achievable.

The second riffles 3*b* are only required to return high specific gravity and large particle diameter gold ore particles separated from the first gold line 40*a* again to the first gold line 40*a*. Thus, the second riffles 3*b* to be provided on the flat area 12 may be only one riffle. In other words, it is only required that at least the one second riffle 3*b* is provided on the flat area 12.

The material of the riffles 3 is not limited to linoleum, but may be rubber material, resin material, metal material, or other known materials. The riffles 3 are not limited to be produced by the method discussed herein which attaches the body sheet provided with long members to the upper surface 2*a* of the shaking table 2 to form the riffles 3 on the upper surface 2*a* of the shaking table 2. Alternatively, the riffles 3 may be directly attached to the upper surface 2*a* of the shaking table 2 to be formed thereon. In addition, the shaking table 2 is not limited to a wooden component, but may be a component made of metal or resin.

EXAMPLES

A width of a gold line produced at the time of recovery of gold concentrates from gold ores, and an overall recovery rate were measured by using a table gravity concentrator including second riffles which are disposed on a flat area of an upper surface of a shaking table. Note that the present invention is not limited to examples described below.

Example 1

In Example 1, a width of a first gold line produced at the time of recovery of gold concentrates from gold ores, and an overall recovery rate were measured under the following experimental conditions by using a table gravity concentrator which includes five second riffles having the same length and disposed at uniform intervals on the flat area of the upper surface of the shaking table as illustrated in FIGS. 2 through 8.

<Experimental Conditions> table gravity concentrator used: manufactured by Diester Industrie oscillation of table gravity concentrator: 150 times/minute 2.54 cm wide solid content of processed ore slurry: 20-40% by weight pH of processed ore slurry: neutrality (slurry containing water and ores)

processing amount of ore slurry: 155 kg/hour measurement method of ore particles: ore particles contained in tailings recovered per unit time were sieved by 100 μm sieve to measure the weight of particles which are 100 μm or larger.

In Example 1, the width of the first gold line was 20 mm, and the overall recovery rate was 60%.

According to Example 1, the width of the first gold line decreased to a width of approximately ⅔ of the width of the first gold line (30 mm) in Comparison Example 1 described below. It is assumed that the decrease in width came from a change of the stream of the high specific gravity and large particle diameter gold ore particles. More specifically, the obstruction of the second riffles switched the stream of the high specific gravity and large particle diameter gold ore particles to the first gold line from a second gold line where the gold ore particles are difficult to recover in the conventional method, and therefore increased the overlap between the stream of the first gold line and the stream of the second gold line. Furthermore, the structure in Example 1 recovered 20% of gold ore particles from large particle diameter ore particles which are difficult to recover in the conventional method. Accordingly, the structure in Example 1 improved the overall recovery rate, and recovered a larger amount of gold concentrates from gold ores in comparison with Comparison Example 1 whose overall recovery rate was 50% as will be described below.

Example 2

In Example 2, a width of a first gold line and an overall recovery rate were measured under the foregoing experimental conditions similarly to Example 1, except that the used table gravity concentrator includes seven second riffles having the same length and disposed at uniform intervals on the flat area of the upper surface of the shaking table as illustrated in FIGS. 9 through 15.

In Example 2, the width of the first gold line was 30 mm, and the overall recovery rate was 63%.

More specifically, in Example 2, the width of the first gold line was equivalent to the corresponding width in Comparison Example 1 described below. However, the width of the first gold line increased while the degree of overlap between the first gold line and a second gold line remains the same. It is assumed from this result that the accuracy of recovery by using a partition plate increased. Moreover, the overall recovery rate in Example 2 increased from the overall recovery rate of 60% in Example 1. Accordingly, with increase in the number of the second riffles from that number in Example 1, the structure in Example 2 improved the overall recovery rate, and recovered a larger amount of gold concentrates from gold ores in comparison with Example 1.

Example 3

In Example 3, a width of a first gold line and an overall recovery rate were measured under the foregoing experimental conditions similarly to Example 1, except that the used table gravity concentrator includes a plurality of second riffles having disposed at uniform intervals on the flat area of the upper surface of the shaking table throughout the range from midstream riffles of first riffles to the left side surface of the shaking table as illustrated in FIGS. 16 through 22.

In Example 3, the width of the first gold line was 30 mm, and the overall recovery rate was 82%. In addition, while the width of the first gold line remains 30 mm in Example 3, it was visually recognized that the linearity of the stream direction of the first gold line improved.

More specifically, in Example 3, the width of the first gold line was equivalent to the corresponding width in Comparison Example 1 described below similarly to Example 2. However, the width of the first gold line increased while the degree of overlap between the first gold line and a second gold line remains the same. It is assumed from this result that the accuracy of recovery by using the partition plate increased. Furthermore, with increase in the number of the second riffles from that number in Example 1 and Example 2, the structure in Example 3 improved the overall recovery rate, and recovered a larger amount of gold concentrations from gold ores in comparison with the overall recovery rate of 60% in Example 1, and the overall recovery rate of 63% in Example 2. It is assumed that this result came not only from the increase in the number of the second riffles from that number in Example 1 and Example 2, but also from the improvement of the linearity of the stream direction of the first gold line in comparison with Examples 1 and 2, achieved while the width of the first gold line and the degree of overlap between the first gold line and the second gold line remain the same as the corresponding width and overlap in Example 2. This improvement of the linearity is assumed to have further increased the accuracy of recovery by using the partition plate from the corresponding accuracy in Examples 1 and 2.

Comparison Example 1

In Comparison Example 1, a width of a first gold line and an overall recovery rate were measured under the foregoing experimental conditions similarly to Example 1, except that the used table gravity concentrator was a conventional table gravity concentrator.

In Comparison Example 1, the overall recovery rate was an insufficient rate of 50%, resulting from the use of the conventional table gravity concentrator. It is assumed that this result came from a low degree of overlap between the first gold line stream and a second gold line stream, exhibited while the width of the first gold line was 30 mm similarly to Examples 2 and 3.

REFERENCE SIGNS LIST

1 table gravity concentrator
2 shaking table
2*a* upper surface
2*b* lower surface
2*c* front side surface
2*d* rear side surface
2*e* right side surface
2*f* left side surface
3 riffle
3*a* first riffle
3$a_1$ upstream riffles
3$a_2$ midstream riffles
3$a_3$ downstream riffles
3*b* second riffle
4 ore supply launder
5 water supply launder
6 dam
7 partition plate
8 first tailing recovery storage tank
9 second tailing recovery storage tank
10 concentrate recovery storage tank
11 oscillation driving mechanism
12 flat area
40*a* first gold line
40*b* tailing layer
102 shaking table
102*c* front side surface
103 riffle
104 ore supply launder
105 water supply launder
107 partition plate
108 first tailing recovery storage tank
109 second tailing recovery storage tank
110 concentrate recovery storage tank
111 oscillation driving mechanism
112 flat area
140*a* first gold line
140*b* tailing layer
140*c* second gold line

What is claimed is:

1. A gold concentrate recovery system comprising:
a shaking table that oscillates;
a plurality of first riffles; and
a second riffle,
wherein the plurality of first riffles and the second riffle are disposed on a surface of the shaking table,
wherein the second riffle is disposed on a flat area of the shaking table,
wherein the second riffle does not contact the plurality of first riffles,
wherein the plurality of first riffles concentrates gold ore particles based on specific gravity of the ore particles with additive water to generate a gold line in the flat area, and
wherein the second riffle is disposed on a downstream of the additive water and on a downstream of the gold line.

2. The gold concentrate recovery system according to claim 1, further comprising a plurality of second riffles that are disposed throughout a range from the plurality of first riffles to a side surface of the shaking table.

3. The gold concentrate recovery system according to claim 1, wherein an end of the second riffle is disposed between two of the plurality of first riffles.

4. The gold concentrate recovery system according to claim 1, wherein a drive mechanism oscillates the shaking table.

5. The gold concentrate recovery system according to claim 4, wherein the drive mechanism oscillates the shaking table in an extension direction of the second riffle or at least one of the plurality of first riffles.

6. The gold concentrate recovery system according to claim 1, wherein the shaking table oscillates in an extension direction of the second riffle or at least one of the plurality of first riffles.

7. A gold concentrate recovery method comprising:
oscillating a shaking table;
concentrating ore particles based on specific gravity of the ore particles with additive water; and
generating a gold line in a flat area on a surface of the shaking table,
wherein the ore particles are gold ore particles,
wherein a plurality of first riffles and a second riffle are disposed on the surface of the shaking table,
wherein the second riffle does not contact the plurality of first riffles,
wherein the second riffle is disposed on a downstream of the additive water and on a downstream of the gold line.

8. The gold concentrate recovery method according to claim 7, wherein a drive mechanism oscillates the shaking table.

9. The gold concentrate recovery method according to claim 8, wherein the drive mechanism oscillates the shaking table in an extension direction of the second riffle or at least one of the plurality of first riffles.

10. The gold concentrate recovery method according to claim 7, wherein the shaking table oscillates in an extension direction of the second riffle or at least one of the plurality of first riffles.

* * * * *